US010179952B2

(12) United States Patent
Amatucci et al.

(10) Patent No.: US 10,179,952 B2
(45) Date of Patent: Jan. 15, 2019

(54) PATTERNED THIN FILMS BY THERMALLY INDUCED MASS DISPLACEMENT

(71) Applicant: Rutgers, The State University of New Jersey, New Brunswick, NJ (US)

(72) Inventors: Glenn G. Amatucci, Peapack, NJ (US); Anthony Ferrer, North Brunswick, NJ (US)

(73) Assignee: Rutgers, The State University of New Jersey, New Brunswick, NJ (US)

( * ) Notice: Subject to any disclaimer, the term of this patent is extended or adjusted under 35 U.S.C. 154(b) by 678 days.

(21) Appl. No.: 14/202,972

(22) Filed: Mar. 10, 2014

(65) Prior Publication Data

US 2015/0014891 A1 Jan. 15, 2015

Related U.S. Application Data

(60) Provisional application No. 61/775,082, filed on Mar. 8, 2013.

(51) Int. Cl.

| | |
|---|---|
| ***B23K 26/00*** | (2014.01) |
| ***B23K 26/08*** | (2014.01) |
| ***C23F 4/02*** | (2006.01) |

(52) U.S. Cl.

CPC ..... *C23F 4/02* (2013.01)

(58) Field of Classification Search

CPC ..... C23F 11/00; C23F 11/02
USPC ..... 264/446–447
See application file for complete search history.

(56) References Cited

U.S. PATENT DOCUMENTS

| | | | | |
|---|---|---|---|---|
| 4,861,964 | A * | 8/1989 | Sinohara | B23K 26/0738 219/121.68 |
| 5,245,156 | A * | 9/1993 | Kamogawa | B23K 26/24 219/121.64 |
| 5,500,503 | A * | 3/1996 | Pernicka | B23K 26/24 219/121.63 |
| 5,502,292 | A * | 3/1996 | Pernicka | B23K 26/24 219/121.63 |
| 6,274,198 | B1 | 8/2001 | Dautartas | |
| 6,355,198 | B1 * | 3/2002 | Kim | A61K 47/48992 264/259 |
| 9,540,235 | B2 * | 1/2017 | Sureshkumar | B82Y 30/00 |
| 2009/0001632 | A1 * | 1/2009 | Stumpe | C08L 79/00 264/334 |
| 2010/0062550 | A1 * | 3/2010 | Buchel | H01L 51/441 438/17 |
| 2010/0221853 | A1 * | 9/2010 | Buchel | H01L 51/0015 438/26 |

(Continued)

OTHER PUBLICATIONS

Glang et al., "Generation of Patterns in Thin Films", Handbook of Thin Film Technology, New York: McGraw-Hill, 1970. 7.1-7.66.

(Continued)

*Primary Examiner* — Nahida Sultana
(74) *Attorney, Agent, or Firm* — Greenberg Traurig, LLP

(57) ABSTRACT

The described invention provides a method of patterning a thin film deposited on a substrate comprising applying a moving focused field of thermal energy to the thin film deposited on the substrate; and dewetting the thin film from the substrate. Dewetting the thin film from the substrate is characterized by a negative space of a desired design; and displacement of the thin film into adjacent structures, thereby accumulating thin film in the adjacent structures.

12 Claims, 36 Drawing Sheets

(56) References Cited

U.S. PATENT DOCUMENTS

2012/0021554 A1* 1/2012 Neel ..... C30B 11/12 438/65
2012/0280216 A1* 11/2012 Sirringhaus ..... G03F 7/11 257/40
2013/0136894 A1* 5/2013 Baker ..... B32B 33/00 428/141
2013/0183492 A1* 7/2013 Lee ..... B05D 3/068 428/148
2014/0042131 A1* 2/2014 Ash ..... B23K 1/0056 219/121.66
2014/0147694 A1* 5/2014 Harrison ..... B23K 26/0081 428/600
2014/0374137 A1* 12/2014 Kwon ..... C21D 8/1288 174/126.3
2015/0174625 A1* 6/2015 Hart ..... B08B 17/065 428/141
2015/0209910 A1* 7/2015 Denney ..... B23K 26/345 219/76.1
2015/0303064 A1* 10/2015 Singer ..... G03F 7/70383 438/694
2015/0369064 A1* 12/2015 Bruck ..... F01D 5/326 228/110.1
2016/0016259 A1* 1/2016 Bruck ..... B23K 26/26 219/121.64
2016/0023304 A1* 1/2016 Bruck ..... B23K 26/0081 219/73.2
2016/0046050 A1* 2/2016 Ikeda ..... B29C 45/14311 264/478

OTHER PUBLICATIONS

Bischof et al., "Dewetting Modes of Thin Metallic Films: Nucleation of Holes and Spinodal Dewetting", Physical Review Letters 77.8 (1996): 1536-1539.
Favazza et al., "Robust Nanopatterning by Laser-induced Dewetting of Metal Nanofilms", Nanotechnology 17 (2006): 4229-4234.
Stange et al., "Nucleation and Growth of Defects Leading to Dewetting of Thin Polymer Films", Langmuir 13.16 (1997): 4459-4465.
Riedel et al., "Nanostructuring of Thin Films by ns Pulsed Laser Interference", Applied Physics A 101 (2010): 309-312.
Riedel et al., "Pulsed Laser Interference Patterning of Metallic Thin Films", Acta Physica Polonica A 121.2 (2012): 385-387.
Rack et al., "Pulsed Laser Dewetting of Patterned Thin Metal Films: A Means of Directed Assembly", Applied Physics Letters 92 (2008): 223108.
Fowlkes et al., "Self-Assembly versus Directed Assembly of Nanoparticles via Pulsed laser Induced Dewetting of Patterned Metal Films", Nano Letters 11 (2011): 2478-2485.
Yagi et al., "Direct observation of contact and channel resistance in pentacene four-terminal thin-film transistor patterned by laser ablation method", Applied Physics Letters 84 (2004) 813-815.
Cho et al., "Patterned Si thin film electrodes for enhancing structural stability", Nanoscale Research Letters 7:20 (2012) 1-5.
Tseng et al., "Laser scribing of indium tin oxide (ITO) thin films deposited on various substrates for touch panels", Applied Surface Science 257 (2010) 1487-1494.
Gecys et al., "Scribing of Thin-film Solar Cells with Picosecond Laser Pulses", Physics Procedia 12 (2011) 141-148.
Ruthe et al., "Etching of CuInSe2 thin films—comparison of femtosecond and picosecond laser ablation", Applied Surface Science 247 (2005) 447-452.
Henderson et al., "Lab-on-a-Chip device with laser-patterned polymer electrodes for high voltage application and contactless conductivity detection", Chem. Commun., 48 (2012) 9287-9289.
Chin et al., "Commercialization of microfluidic point-of-care diagnostics devices", Lab Chip 12 (2012) 2118-2134.
Levy et al., "Metal-oxide thin-film transistors patterned by printing", Applied Physics Letters 103 (2013) 043505.
Gentili et al., "Applications of dewetting in micro and nanotechnology", Chem. Soc. Rev. 41 (2012) 4430-4443.
Sharma et al., "Energetic Criteria for the Breakup of Liquid Films on Nonwetting Solid Surfaces", Journal of Colloid and Interface Science 137.2 (1990) 433-445.
Xie et al., "Spinodal Dewetting of Thin Polymer Films", Physical Review Letters 81.6 (1998) 1251-1254.
Pandit et al., "Hydrodynamics of the rupture of thin liquid films", J. Fluid Mech. 212.11 (1990) 11-24.
Redon et al., "Dynamics of Dewetting", Physical Review Letters 66.6 (1991) 715-718.
Kuznetsov et al., "Nanostructuring of thin gold films by femtosecond lasers", Applied Physics A 94 (2009) 221-230.
Torkamany et al., "The effect of process parameters on keyhole welding with a 400 W Nd:YAG pulsed laser", Journal of Physics D: Applied Physics 39 (2006) 4563-4567.
Jeong et al., "UV-visible and infrared characterization of poly(p-xylylene) films for waveguide applications and OLED encapsulation," Synthetic Metals 127 (2002) 189-193.
Krishna et al., "Thickness-dependent spontaneous dewetting morphology of ultrathin Ag films," Nanotechnology 21 (2010) 155601.

* cited by examiner

46

48

50

52

134
130
126
134
132
144
128
200 um
150 um
100 um
75 um
65 um
55 um
136
138
140
142
154
200 um
125 um
100 um
85 um
75 um
146
148
150
152
Bismuth-black
Tin

208

200
192

196
198
198
196
500 µm
500 µm
190
202
192
204
194
206

PATTERNED THIN FILMS BY THERMALLY INDUCED MASS DISPLACEMENT

CROSS-REFERENCE TO RELATED APPLICATIONS

This application claims the benefit of priority to U.S. Provisional Application 61/775,082 (filed Mar. 8, 2013), the contents of which are incorporated by reference in its entirety.

STATEMENT OF GOVERNMENT FUNDING

This invention was made with government support. The government has certain rights in the invention.

FIELD OF THE INVENTION

The described invention addresses a new way of patterning thin films which overcomes the shortcomings of approaches used today. More specifically, the described invention utilizes a technique to apply a relatively low powered focused beam to dewet a metal from a substrate and effectively write the negative space of the desired design without significant loss of deposited film mass and little damage to heat sensitive substrates. Additionally, this process allows one to displace material into adjacent structures, thereby building film thickness, without the requirement of depositing thicker films.

BACKGROUND OF THE INVENTION

Thin film patterning is an essential technology that has enabled the miniaturization of many technologies in both the electronics and biomedical fields. Patterned thin films can be found in a variety of electronics applications including batteries, solar cells, transistors, microfluidics, patch antennas, and touch panels [Yagi, I., et al., "Direct observation of contact and channel resistance in pentacene four-terminal thin-film transistor patterned by laser ablation method," *Appl. Phys. Lett.* 84 (2004) 813-815; Cho, G., et al., "Patterned Si thin film electrodes for enhancing structural stability," *Nanoscale Research Letters* 7:20 (2012) 1-5; Tseng, S-F., et al., "Laser scribing of indium tin oxide (ITO) thin films deposited on various substrates for touch panels" (2010); Gecys, P., et al., "Scribing of Thin-film Solar Cells with Picosecond Laser Pulses" (2011); Ruthe, D., et al., "Etching of CuInSe2 thin films—comparison of femtosecond and picosecond laser ablation" (2005)]. The biomedical field has developed a great need for such thin electrode arrays as well, particularly for point-of-care applications. Concepts such as the "lab-on-chip," implantable sensors, and ingestible probes rely on the biotech industry's ability to accurately and reproducibly create microscopic electrical conduits on increasingly thin substrates [Henderson, R. D., et al., "Lab-on-a-Chip device with laser-patterned polymer electrodes for high voltage application and contactless conductivity detection" *Chem. Commun.,* 48 (2012) 9287-9289; Chin, C. D., et al., "Commercialization of microfluidic point-of-care diagnostics devices," *Lab Chip* 12 (2012) 2118-2134]. Additionally, the use of organic, flexible substrates will allow implementation of such electrodes into a wider range of products for both industries that can provide users and researchers with highly adaptable geometries for consumer and industrial electronics. If devices are to progressively occupy less space and continually exhibit higher functionality, all while remaining relatively low cost, then industrial processes must match this demand by developing innovative ways of patterning deposited thin films.

Two of the most prevalent modes of patterning thin films are shadow masked deposition and photolithography [Glang, Reinhard, and Lawrence V. Gregor. "Generation of Patterns in Thin Films." *Handbook of Thin Film Technology*, New York: McGraw-Hill, (1970) 7.1-7.66]. The former technique requires the creation of multiple yet expensive masks, which make changing designs, even slightly, both costly and time-consuming. The latter technique also uses masks for the purposes of patterning the area of exposure and incorporates various photoresists and chemical development steps leading to highly accurate features. In turn, the process is complicated and introduces the need for a number of extra environmental engineering controls to deal with such potentially harmful chemicals. Some of drawbacks can be mitigated by using directed energy techniques to scribe out the negative space of a film, precluding the need for masks or etching steps. Such processes can use focused e-beams or laser radiation coupled with a scanning system to reduce production time, however, these techniques are still primarily subtractive in nature and result in the vaporization of a great deal of material that cannot be recovered. Other techniques, including those that are additive in nature (e.g. ink jet printing) [Levy, D. H., et al., "Metal-oxide thin-film transistors patterned by printing," *Appl. Phys. Lett.* 103 (2013) 043505], have their own drawbacks that must be overcome during implementation into current manufacturing processes. An alternative to current patterning techniques involves the use of dewetting to build patterned structures from an initially uniform target layer.

The shape of liquids on solid surfaces is dictated by the contact angle (FIG. 10). The latter is related to the materials' surface energy by the Young's Equation (Equation 1), where $\theta_c$ is the contact angle in thermodynamic equilibrium. Liquids that completely wet the solid correspond to $\theta_c=0°$. Angles between 0° and 90° can be considered partially wetting, while angles greater than 90° are formed by non-wetting liquids. The wetting nature of a material can be described by the change in free energy with respect to the standard state, i.e. complete wetting of the solid by the liquid [Gentili, D., et al., "Applications of dewetting in micro and nanotechnology," *Chem. Soc. Rev.* 41 (2012) 4430-4443]. This free energy is a combination of gravitational forces, intermolecular forces, and surface tension (Equation 2). Surface topography will affect the apparent contact angle and by consequence the measured surface energy; however, materials will exhibit surface energy values in general domains intrinsic to material classification. For example, metals tend to lie in the highest range of surface energy values, while materials such as polymers tend to have the lowest values. Interfacial force influences the dewetting of metallic films deposited on substrates such as glass or polymeric compounds and can be measured by the spreading coefficient S (Equation 3). A film will spontaneously dewet when the change in free energy $S<0$ and has a thickness less than a critical height. In turn, this critical height is a function of capillary length and equilibrium contact angle and provides the basis for determining energetic stability of the film with respect to the substrate [Sharma, A. and Ruckenstein, E. "Energetic Criteria for the Breakup of Liquid Films on Nonwetting Solid Surfaces," *Journal of Colloid and Interface Science.* 137, 2 (1990) 433-445]. Studies on polymer films have shown that dewetting can occur by a number of mechanisms, including nucleation and growth of holes within the film and spontaneous spinodal dewetting [Stange, T. G., Evans, D. F., "Nucleation and Growth of Defects Leading to Dewetting of Thin Polymer Films" *Langmuir* 13 (1997) 4459-4465; Xie, R., et al., "Spinodal Dewetting of Thin Polymer Films," *Phys. Rev. Lett.* 81, 6 (1998) 1251-1254]. Researchers have also initiated dewetting in films that would not do so independently. A number of mechanical methods have been employed, rather than relying on random impurities to serve as nucleation points [Pandit, A. B., and Davidson, J. F. "Hydrodynamics of the rupture of thin liquid films" *J. Fluid Mech.* 212, 11 (1990) 11-24; Redon, C., et al., "Dynamics of Dewetting" *Phys. Rev. Lett.* 66, 6 (1991) 715-718]. By introducing this external energetic input, some control is established over the dewetting geometry and progression of a film on non-wetting surfaces.

$$\gamma_{SL} + \gamma_{LG}\cos\theta_c = \gamma_{SG} \tag{1}$$

$$\Delta F(h) = \frac{1}{2}\rho g h^2 - S + \frac{A}{12\pi h^2} \tag{2}$$

$$S = \gamma_{SG} - (\gamma_{SL} + \gamma_{LG}) \tag{3}$$

The described invention presents a novel variation on induced dewetting which allows for rapid, directed patterning through the use of a high speed scanning laser. For example, by taking a relatively low-powered Yb doped fiber laser and scanning it across the surface of a metallic thin-film, targeted melting and dewetting of the target film can be achieved without damaging the underlying polymer substrate. There is some precedent for induced dewetting of metallic, thin film targets under a variety of non-scanning laser radiation conditions. In 1996, Bischof et. al. studied the dewetting modes of thin films after exposure from frequency doubled Nd:YAG radiation [Bischof, J., et al., "Dewetting Modes of Thin Metallic Films: Nucleation of Holes and Spinodal Dewetting," *Physical Review Letters* (1996) 77 (8) 1536-1539]. The authors demonstrate that deposited Au, Cu, and Ni thin films, which are metastable in nature, will dewet upon induced melting and will do so by nucleation of holes or by a spontaneous, spinodal fashion. Other researchers have built upon this dewetting phenomenon to create self-assembled features on Co nano-films by using defocused laser light and pulses in the nanosecond regime [Favazza, C., et al., "Robust nanopatterning by laser-induced dewetting of metal nanofilms," *Nanotechnology* 17 (2006) 4229-4234]. It was shown that characteristic length scales developed as functions of the number pulses used, which allowed some control over the final dimensions of the pattern. Splitting a laser source into two or three beams to create interference has enabled the creation of periodic patterns on a variety of thin-film species, including Bi, Ge, Ni, Au, Cu, and Ta. Changing the arrangement and number of beams allows even more control over pattern design; however, such techniques are very much limited to lines, hexagonal patterns, and others associated with intensity interference [Riedel, S., et al., "Nanostructuring of thin films by ns pulsed laser interference," *Appl Phys A* 101, (2010) 309-312; Riedel, S., et al., "Pulsed Laser Interference Patterning of Metallic Thin Films" *Acta Physica Polonica A* 121, 2 (2012) 385-387]. Placing masks along the beam path, which are then focused down to a smaller scale, offered additional freedom in shape patterning similar to photoresist methods, but suffer from the same drawbacks [Kuznetsov, A. I., et al., "Nanostructuring of thin gold films by femtosecond lasers," *Appl Phys A* 94, (2009) 221-230]. Pre-patterning of the thin film, followed by laser exposure imposes constraints on the acting surface tension in the melt and allowed a "directed assembly" of the dewetted material [Rack, P. D., et al., "Pulsed laser dewetting of patterned thin metal films: A means of directed assembly" Applied Physics Letters 92, 223108 (2008); Fowlkes, J. D., et al., "Self-Assembly versus Directed Assembly of nanoparticles via Pulsed Laser Induced Dewetting of Patterned Metal Films" *Nano Letters* 11 (2011), 2478-2485]. The techniques still require the creation of masks for electron lithography and the subsequent use of lift-off processes, which hinders the speed of implementation. In sharp contrast to the aforementioned techniques, the processing technique of the described invention relies on a number of system features, namely a high speed scanning system that affords the user a great deal of freedom in rapid direct scribe dewetting programs, while eliminating the need for costly lithographic masks and time-consuming pre-patterning steps.

Choice of system materials is crucial to the technique of the described invention as a number of attributes can affect both the dewetting behavior of the metal as well as its interaction with the laser radiation (Table 1). For example, bismuth as the deposited metal has a relatively low melting-point with a much higher vaporization-point, and a large liquid surface tension value. Additionally, bismuth absorbs a relatively large percentage of incident near-infrared (NIR) radiation, whereas other metals may reflect a much larger percentage of incident radiation at that wavelength. The combination of low melting temperature and higher absorption makes it particularly applicable to polymer substrates. Tin presents as another viable candidate, as it also has a low melting point, high vaporization point, high surface tension, and exhibits relatively high absorption of NIR light. However, lasers of shorter wavelengths can be utilized to enable a wide array of metals due to improved absorption characteristics. One specific phase of a material may preferentially couple with one laser wavelength over another and thus affect the ability to melt and dewet from a substrate without significant amounts of material loss. (PVD) of the target metal on the substrate, for example, enables extremely fast cooling rates and the kinetic stabilization of metal films and a metastable, uniform wetting of the substrate.

A suitable substrate would exhibit a lower surface energy than a metal, would be an insulator, and would also have reduced absorption of NIR light to avoid destruction during laser processing. Reduced absorption also allows "back-side" dewetting by transmission through the substrate. For example, both borosilicate glass and parylene-C (par-C) meet these criteria. Where glass is highly transparent to NIR light, the surface energy is relatively high compared to most polymers. Par-C boasts a surface energy comparable to polytetrafluoroethylene (PTFE) polymers, making it relatively easy for deposited metal to dewet from the surface. The polymer can be deposited upon a borosilicate glass slide, which provides the necessary rigidity during processing, but still allows subsequent removal from the substrate. By no means limiting, other substrates can also be utilized, in addition other substrates that have properties that initially seem unsuitable, such as other metals, can be enabled by a thin coating of the of the suitable substrate such as parylene on the surface. Physical vapor deposition

TABLE 1

Relevant properties of target and substrate candidates

| Material | Solid Density [g/cm³] | Liquid Density [g/cm³] | M.P. [° C.] | Surface Energy [mJ/m²] Solid | Surface Energy [mJ/m²] Liquid | Absorption at 1000 nm [%] |
|---|---|---|---|---|---|---|
| Parylene-C | 1.289 | — | 290 | 19.6 | — | <15 |
| Parylene-N | 1.11 | — | 420 | 45 | — | <10 |
| Borosilicate Glass | 2.23 | — | 821 (soften) | 253.0 | — | <3 |
| Polyimide (Kapton) | 1.42 | — | 400 (soften) | 53 | — | <10 |
| PTFE (Teflon) | 2.2 | — | 327 | 20 | — | <10 |
| PVDF homopolymer (Kynar) | 1.78 | — | 177 | 30.3 | — | — |
| Bismuth | 9.78 | 10.05 | 271.5 | 382 | 378 | — |
| Tin | 7.365 | 6.99 | 231.93 | 514 | 554 | 46 |
| Zinc | 7.14 | 6.57 | 419.55 | — | 811 | 20 |
| Gallium | 5.91 | 6.095 | 29.85 | — | 707 | — |
| Antimony | 6.697 | 6.53 | 630.63 | — | 384 | 45 |
| Aluminum | 2.7 | 2.375 | 660.32 | 41.2 | 914 | 29 |
| Indium | 7.31 | 7.02 | 1499.85 | — | 559 | — |
| Silver | 10.49 | 9.32 | 962 | 1302 | 930 | <5 |

The described invention provides a new method of patterning metallic thin films that overcomes the deficiencies of the current methods. Through the use of a focused laser deflected by a high-speed, galvanometer scanning system, a variety of fine metal patterns can be realized on a number of inorganic and organic substrates. This method exploits the metastable wetting characteristics of metallic thin films as deposited by physical vapor deposition or other techniques upon non-metallic substrates. Differences in surface energy and intermolecular forces between the target and the substrate provide a driving force for retraction of the thin film, while the thermal energy from the laser provides the energy needed to overcome the kinetic barrier. Electronically isolated feature sizes in the range of the tens of microns can be fabricated. During formation, material is displaced rather than ablated allowing controlled accumulation of the target material. This results in a user-determined increase of the metal feature thickness. The described invention provides for the creation of accurate and reproducible periodic structures, as well as complex designs. This technique provides an alternative to current thin film patterning techniques and introduces a new way of building out-of-plane structures in thickness from metallic thin films. This process easily lends itself to integration into existing industrial processes.

SUMMARY OF THE INVENTION

According to one aspect, the described invention provides a method of patterning a thin film deposited on a substrate comprising: (A) applying a moving focused field of thermal energy to the thin film deposited on the substrate; and (B) dewetting the thin film from the substrate, the dewetting being characterized by: (i) a negative space of a desired design; and (ii) displacement of the thin film into adjacent structures, thereby accumulating thin film in the adjacent structures.

According to one embodiment, the focused field of thermal energy is from a laser. According to another embodiment, the focused field of thermal energy is at a wavelength matched to the wavelength absorbed by the thin film. According to another embodiment, the wavelength is not absorbed by the substrate.

According to one embodiment, the thin film is an inorganic compound. According to another embodiment, the thin film is comprised of a metal or metal alloy. According to another embodiment, the metal is comprised of bismuth. According to another embodiment, the metal is comprised tin.

According to one embodiment, the substrate is an inorganic substance. According to another embodiment, the inorganic substance is selected from the group consisting of glass, ceramic, silicon oxide and silicon nitride. According to another embodiment, substance is glass. According to another embodiment, the glass is borosilicate glass.

According to one embodiment, the substrate is a polymer. According to another embodiment, the polymer is parylene. According to another embodiment, the parylene is parylene C.

According to one embodiment, the substrate is a polymer coated on an inorganic substance. According to another embodiment, the polymer is parylene. According to another embodiment the parylene is parylene C. According to another embodiment, the inorganic substance is selected from the group consisting of glass, ceramic and metal. According to another embodiment, the inorganic substance is glass. According to another embodiment, the glass is borosilicate glass.

According to one embodiment, the dewetting is further characterized by minimal ablation of the thin film. According to another embodiment, the minimal ablation of the thin film is less than 10%. According to another embodiment, the minimal ablation of the thin film is less than 5%. According to another embodiment, the minimal ablation of the thin film is less than 3%. According to another embodiment, the minimal ablation of the thin film is 2.8%. According to another embodiment, the minimal ablation of the thin film is 0.5%.

According to one embodiment, a patterned film on a substrate is obtained by the method according to claim 1. According to another embodiment, the patterned film is used for the fabrication of flexible and non flexible electronics, neural arrays, sensors, electrochromics, electrochemical actuators, artificial muscles, batteries, capacitors, displays, electrochemical actuators, mechanical energy harvesters, micro fluidic devices, artificial eyes, and antennae.

BRIEF DESCRIPTION OF THE DRAWINGS

For a more complete understanding of the present disclosure, reference is made to the following detailed description of exemplary embodiments considered in conjunction with the accompanying drawings.

FIGS. 4A, 4B, and 4C show data related to a second "cone" structure prepared by a second spiral scan according to an embodiment of the present invention, wherein FIG. 4A is a histogram prepared by scanning the second cone structure, FIG. 4B shows height measurements of the second cone structure indicating an 80 um build up from 1.4 um of base material, and FIG. 4C shows an analysis of the second cone after correcting for tilt and possible curvature of the surface, the analysis showing that, out of $9.5\times10^6$ $um^3$ of displaced volume, only $2.6\times10^5$ $um^3$ of negative volume is unaccounted for;

FIGS. 5A, 5B, 5C, 5D, 5E, and 5F show dewetting lines according to an embodiment of the present invention and profilometer scans, wherein FIG. 5A is a profilometer scan of the dewetting lines of Figure D, which have a 75 μm spacing, FIG. 5B is a profilometer scan of the dewetting lines of Figure E, which have a 65 μm spacing, and FIG. 5C is a profilometer scan of the dewetting lines of Figure F, which have a 55 μm spacing;

Figures 24A, 24B:
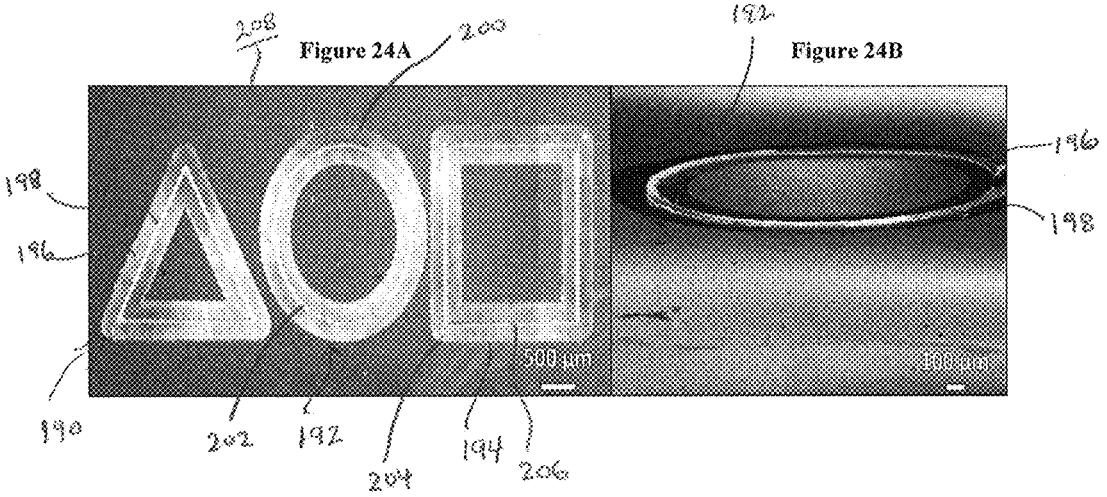
Figure 25:
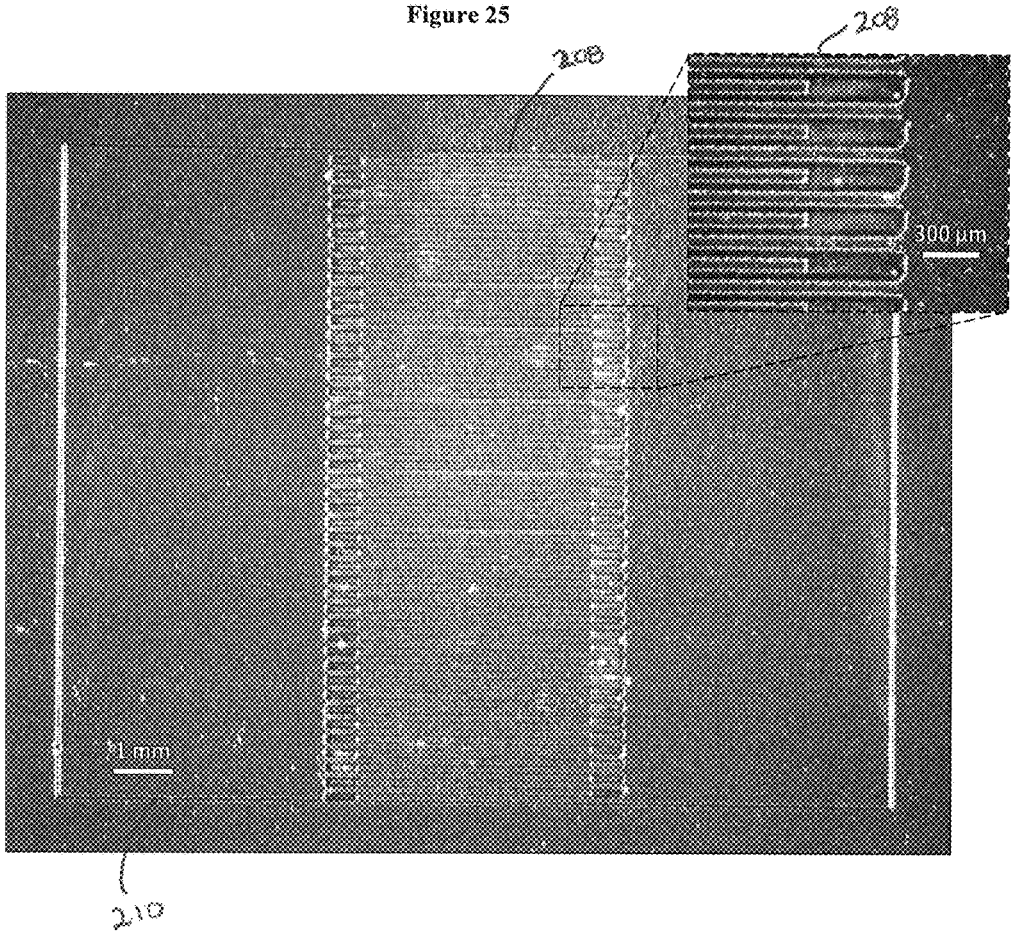
Figure 26:
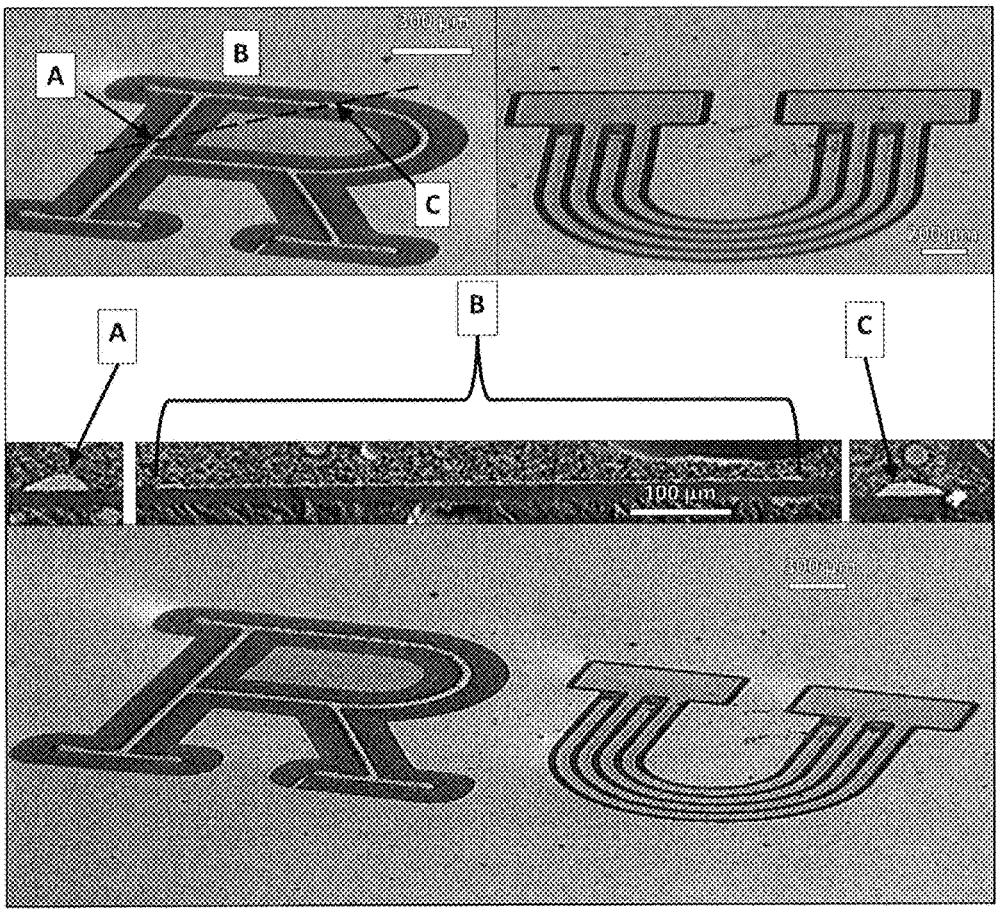

μm×70 μm×100 μm, and each pass of the beam left a spacing of 30 μm of exposed parylene-C;

FIGS. 24A and 24B show a top-down view of polygonal and circular built structures according to an embodiment of the present invention (FIG. 24A), and tilted field emission scanning electron microscopy (FESEM) scans illustrating the height contrast between the deposited target film and the constructed features (FIG. 24B);

FIG. 25 shows an example of an inter-digit electrode system, according to an embodiment of the present invention, wherein the inter-digit electrode system was prepared using only one pass of the beam between each pair of electrode digits; and FIG. 26 shows the complex shapes "R" (upper left and bottom panels) and "U" (upper right and bottom panels) formed out of target film, and electron microscope cross-sections of the "R" shape shown in the upper left panel are shown in the middle panel, with A, B and C of the upper left panel corresponding to A, B and C of the middle panel.

DETAILED DESCRIPTION OF THE INVENTION

The described invention can be better understood from the following description of exemplary embodiments, taken in conjunction with the accompanying figures and drawings. It should be apparent to those skilled in the art that the described embodiments of the described invention provided herein are merely exemplary and illustrative and not limiting.

Definitions

Various terms used throughout this specification shall have the definitions set out herein.

The terms "ablate," "ablated" and "ablation" as used herein, refer to the loss, removal or destruction of a material, especially by cutting, abrading or evaporating.

The term "absorb" and all variations thereof, means to take (e.g., a liquid) or draw (e.g., light, energy, etc.) in; to transform (e.g., radiant energy) into a different form especially with a resulting rise in temperature.

The term "accumulate," and all variations thereof, means to gather, acquire or increase in amount.

The term "back-side exposure" as used herein refers to thermal energy (e.g., laser light) that is directed through substrate before interacting with a material (e.g., a metallic layer).

The terms "deposit," "deposited," and "deposition" as used herein, refer to the act of placing, putting or leaving an amount of substance or material on a surface or area; the amount of substance or material placed on a surface or area.

The terms "dewet," "dewetting," "dewetted" and all variations thereof, refer to rupture or displacement of a thin film on a liquid or solid substrate.

The term "flexible" as used herein, refers to the capability of being flexed, turned, bowed, twisted or bent without breaking.

The term "front-side exposure" as used herein, refers to the interaction of thermal energy (e.g., laser light) with a material (e.g., a metallic layer) before or without the thermal energy (e.g., laser light) being directed through a substrate.

The term "pitch" as used herein, refers to the distance between any of various things (e.g., spacing between individual lines in an array).

The term "profilometer" as used herein, refers to an instrument used to measure a surface in order to quantify its thickness and roughness. A profilometer is capable of measuring the surface of a variety of objects, including but not limited to, solids, liquids, interiors of bores and tubes, cylinders, spherical shapes, hot surfaces, cold surfaces and radioactive surfaces. A profilometer can acquire high-aspect-ratio surface features such as channels, grooves, steps, sharp edges, and the like.

The terms "push," "pushing," and all variations thereof, refer to the movement of existing material across the surface of a substrate to build height of features that would otherwise require an amount of additional material deposition.

The term "substrate" as used herein, refers to a solid substance or medium to which a material is applied or deposited. Non-limiting examples of substrates include borosilicate glass microscope slides and parylene-C deposited on glass.

The term "surface tension" as used herein, refers to the contractive tendency of the surface of a liquid that allows it to resist an external force. Surface tension is measured as the energy required to increase the surface area of a liquid by a unit area.

The term "thermal energy" as used herein, refers to the form of energy that is created by heat or by an increase in temperature. An example of a thermal energy source, includes but is not limited to, a laser.

The term "parylene" as used herein, refers to the trade name for chemical vapor deposited poly(p-xylylene) polymers.

The described invention addresses a new way of patterning thin films which addresses the shortcomings of approaches used today. The fundamental approach of this technique is to apply a relatively low powered focused beam to dewet the metal from the substrate and effectively write the negative space of the desired design without significant loss of the deposited film mass and little damage to heat sensitive substrates. The laser can be driven by computer aided control to write patterns as needed. A secondary ability of this process allows one to displace the material into adjacent structures thereby building film thickness without the requirement of depositing thicker films.

According to one embodiment, the described invention provides an integrated laser system. The integrated laser system can include, but is not limited to, a single-mode, Yb-doped fiber laser. The Yb-dobed laser, for example, can be capable of outputting a 100 Watt (W) beam at a wavelength of 1070 nm. Deflection of the beam can be achieved, for example, through a computerized scan system fitted with copper mirrors mounted on galvanometer scan motors. Optics for the scan system can include, but are not limited to, an f-theta, telecentric lens with an effective focal length (EFL) of 115 mm, which provides a marking field of 60 mm by 60 mm. By way of non-limiting example, the construction of the lens can allow for a flat focal plane and consistent laser intensity to all parts of the work piece.

According to another embodiment, galvanometer movement and laser control can be performed manually or by a computer. The computer can use custom designed or manufacturer supplied programs.

According to one embodiment, the described invention can use a focused and writable heat source such as a laser beam to induce a localized dewetting of a substrate and a complete migration of material to adjacent areas of a film as driven by surface tension. The described invention also provides "pushing" of material across the surface of a substrate to build height of features that would otherwise require excessive amounts of thin film deposition. According to one embodiment, the dewetting can be "front-side"

dewetting. According to another embodiment, the dewetting can be "back-side" dewetting.

According to one embodiment, the described invention provides dewetting of a metal by laser radiation. Characteristics of the metal may include, but are not limited to, a low melting-point, a much higher vaporization-point, a large liquid surface tension value and absorption of a relatively large percentage of incident near-infrared (NIR) radiation. Non-limiting examples of suitable metals include bismuth, tin, zinc, gallium, antimony, aluminum, indium and silver. According to one embodiment, the metal is bismuth. According to another embodiment, the metal is tin.

According to one embodiment, the metal is deposited on a substrate. The metal can be deposited on a substrate using techniques known in the art. For example, metal can be deposited on a substrate by chemical deposition or physical deposition. Non-limiting examples of chemical deposition include electrochemical plating, solution deposition, spin coating, chemical vapor deposition, plasma enhanced chemical vapor deposition, atomic layer deposition and the like. Examples of physical vapor deposition include, but are not limited to vacuum assisted approaches such as thermal evaporation, electron beam evaporation, sputtering, pulsed laser deposition, cathodic arc deposition, molecular beam epitaxy, and the like.

Characteristics of the substrate include, but are not limited to, materials with lower surface energy than the metal film, an insulator and reduced absorption of NIR light in order to avoid destruction during laser processing. Reduced absorption of NIR light also allows "back-side" dewetting to occur by transmission of the laser (i.e., NIR light) through the substrate. Non-limiting examples of suitable substrates include parylene-C, parylene-N, parylene-F, parylene D, parylene AF-4, parylene VT-4, borosilicate glass, polyimide (Kapton), polytetrafluoroethylene (PTFE) (Teflon), and polyvinylidene fluoride (PVDF) homodimer (Kynar). According to another embodiment, the substrate is and inorganic such as glass, ceramic, borosilicate glass, silicon oxide, silicon nitride, aluminum nitride. According to another embodiment, the substrate is metal, glass or ceramic substrates coated with a film of parylene.

Through accurate positioning of the laser beam, more complex, directed dewetting towards one side of the beam path can be realized. This in turn can create a variety of shapes and structures. Non-limiting examples of shapes and structures include a line array, a bead, a spiral, circular shapes, metal wells, periodic shapes, polygonal shapes and complex structures. Examples of beads include, but are not limited, single, linear thick beads. Non-limiting examples of periodic shapes include triangles. Non-limiting examples of polygonal shapes include a triangle, a square and a cone. Examples of complex structures include, but are not limited, alphanumeric characters. Alphanumeric characters can include, but are not limited to, letters, numbers, punctuation marks and mathematical symbols.

In addition to the variety of shapes and structures that can be realized through accurate positioning of the laser beam, the described invention allows for cross-hatched geometry characterized by two arrays superimposed upon one another where one is offset at a 90° angle relative to the other. Laser settings of the described invention include, but are not limited to, 50 kHz, 5 μs, 10 Watts (W), 350 mm/s, cover gas at 80 standard cubic feet per hour (SCFH). The dewetted areas can be centered, for example, 75 μm apart with a beam width of 30-35 μm. The absorption layer, for example, can consist of 2.0 μm of bismuth. Low-absorption substrates can consist of, for example, 16 μm of parylene-C polymer on top of 1 mm of borosilicate glass.

The dewetting technique of the described invention can be applied to a variety of technical fields. Such practical applications can include, but are not limited to, flexible and non flexible sensors, electrochemical devices, flexible and nonflexible electronics, neural arrays, electrochromics, electrochemical actuators, artificial muscles, batteries, capacitors, displays, mechanical energy harvesters, micro fluidic devices, artificial eyes, and antennae.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges which may independently be included in the smaller ranges is also encompassed within the invention, subject to any specifically excluded limit in the stated range. Where the stated range includes one or both of the limits, ranges excluding either both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, exemplary methods and materials have been described. All publications mentioned herein are incorporated herein by reference to disclose and described the methods and/or materials in connection with which the publications are cited.

It must be noted that as used herein and in the appended claims, the singular forms "a", "and", and "the" include plural references unless the context clearly dictates otherwise.

The publications discussed herein are provided solely for their disclosure prior to the filing date of the present application and each is incorporated by reference in its entirety. Nothing herein is to be construed as an admission that the present invention is not entitled to antedate such publication by virtue of prior invention. Further, the dates of publication provided may be different from the actual publication dates which may need to be independently confirmed.

EXAMPLES

The following examples are put forth so as to provide those of ordinary skill in the art with a complete disclosure and description of how to make and use the present invention, and are not intended to limit the scope of what the inventors regard as their invention nor are they intended to represent that the experiments below are all or the only experiments performed. Efforts have been made to ensure accuracy with respect to numbers used (e.g. amounts, temperature, etc.) but some experimental errors and deviations should be accounted for. Unless indicated otherwise, parts are parts by weight, molecular weight is weight average molecular weight, temperature is in degrees Centigrade, and pressure is at or near atmospheric.

Example 1: Laser System

The integrated laser system consisted of a single-mode, Yb-doped fiber laser (SPI redPOWER R4-HS) capable of outputting a 100 Watt (W) beam at a wavelength of 1070 nm. Deflection of the beam was achieved through a computerized scan system (Scanlab IntelliSCAN 20) fitted with copper mirrors, which were mounted on galvanometer scan motors to allow precise and rapid movement. A camera system (uEye GigE) for in-situ monitoring of the scribing/dewetting process was mounted in-line with the laser column to allow easier viewing and targeting during operations. Optics for the scan system consisted of an f-theta, telecentric lens with an effective focal length (EFL) of 115 mm, which provides a marking field of 60 mm by 60 mm. The construction of the lens allows for a flat focal plane and consistent laser intensity to all parts of the work piece. The laser column was mounted over a custom weld substrate holder fixture that consisted of a custom designed 2-axis tilt-leveling stage and a manually adjustable Z-axis control to allow adjustment of the beam diameter seen by the material. All galvanometer movement and laser control was performed by a computer using manufacturer supplied programs.

Example 2: Substrate Preparation

Borosilicate glass slides (VWR microscope slides) provided the underlying substrate for all samples. These slides measured 25.4 mm×76.2 mm×1.0 mm and arrived precleaned. Parylene-C (par-C) (Specialty Deposition Systems, P D S 2010) was deposited on the slides at a nominal thickness of 22 μm±1 μm. Average surface roughness (Ra) of deposited par-C varied between 22 and 35 nm. Unmasked metal deposition upon both glass and par-C substrates was carried out using high vacuum thermal evaporation. Samples were kept under an inert argon (Ar) atmosphere until immediately prior to laser exposure and were stored in an inert atmosphere immediately following exposure until characterization was performed.

Example 3: General Laser Parameters

Laser power was held at its lowest operating limit of 10 W for all target metals and substrates to minimize thermal degradation. At the focal plane of the lens, the beam spot's diameter ($D_S$) was calculated using Equation 4, where f is the focal length of the lens, λ is the laser wavelength, $D_B$ is the full-width, half-maximum (FWHM) beam diameter measured as it enters the lens, and $M^2$ is the beam quality factor describing the shape of the intensity distribution (where M=1 for perfect Gaussian distributions).

$$D_S=1.27*f*\lambda*M^2/D_B \quad (4)$$

The laser system was operated in a single-mode ($TEM_{00}$) fashion, with $M^2<1.1$ and produced a 5 mm±0.5 mm wide beam at its exit aperture. The beam had a divergence <0.4 mrad and entered the lens aperture with a diameter of 5.07 mm. Calculation of the spot diameter yielded 33 μm. Measurement of the width of the dewetted area resultant from a single pass of the beam confirmed the diameter calculation. Exposures of larger areas were carried out by scanning the beam across the surface of the target metal. The top-down edge profile of a single, dewetting pass can depend on a number of variables, including laser absorbance, thermal conductivity, solidification rate and thickness of the target metal. Pulse overlap can also influence the edge profile of the dewetted area as viewed from a top-down angle, where low overlap percentage can produce a scalloped edge. The overlap parameter was calculated using Equation 5, where V is the scan speed, f is the pulse frequency, T is the pulse length, and S is the spot size [Torkamany, M. J., et al., "The effect of process parameters on keyhole welding with a 400 W Nd:YAG pulsed laser,"*Journal of Physics D: Applied Physics.* 39 (2006) 4563-4567]. On bismuth targets measuring 1.6 μm in thickness, an overlap exceeding 75% was found to avoid a scalloped edge profile along the dewetted area. Pulse frequency and length were kept constant at 50 kHz and 5 μs respectively, while the beam was scanned at 240 mm/s. Under the described conditions, the calculated overlap was 86%.

$$O_f=[1-(V/f)/(S+VT))]\times 100 \quad (5)$$

Tin targets measuring 1.6 μm in thickness require a greater degree of overlap to avoid a scalloped top-down edge profile. Laser pulse frequency and length were held constant at 50 kHz and 5 μs respectively, while scan speed was conducted at 100 mm/s to achieve a calculated overlap of 94%. To prevent significant amounts of oxidation within the dewetted material, an argon gas blanket flowed at 80 standard cubic feet per hour (SCFH) over the sample during dewetting cycles. Pulse shaping corrections were enabled to prevent the spike in delivered power; a characteristic of the laser's first pulse. For dewetting geometries consisting of multiple passes or segments, the scanner's positioning speed was set equal to the marking speed designated for that metallic target.

Example 4: Compatibility of Different Low-Absorption Substrates

Figure 9A:
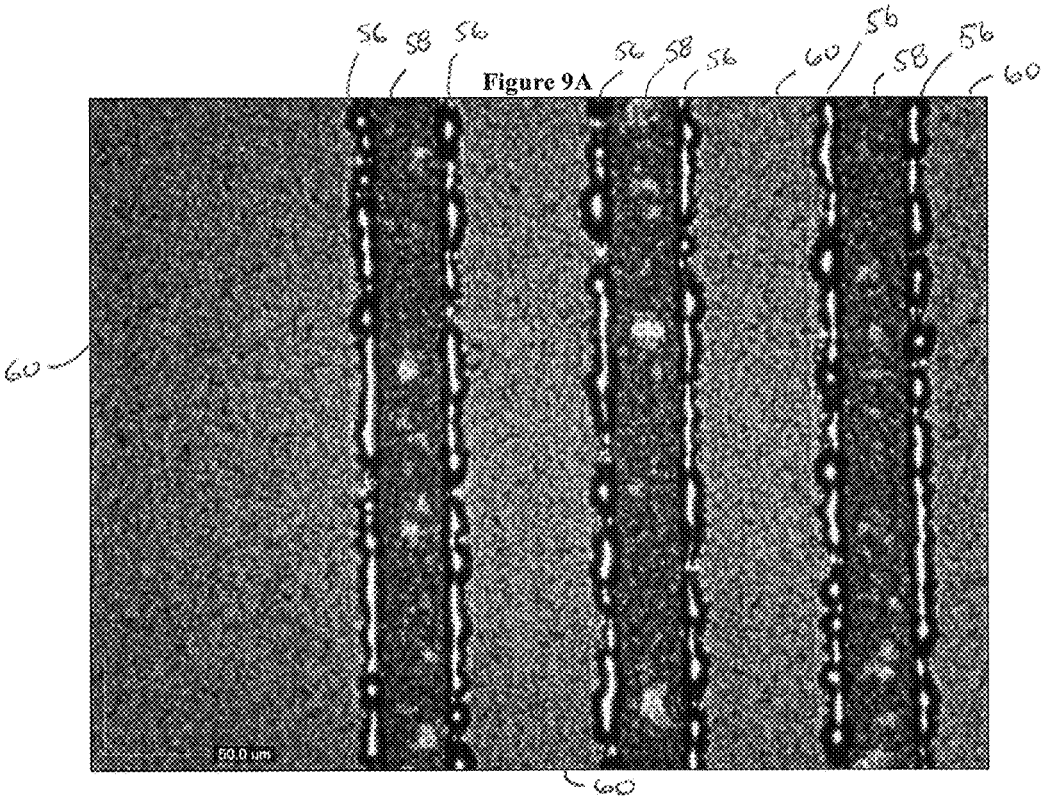
FIGS. 9A and 9B show small arrays of dewetted lines on top of a borosilicate glass substrate (FIG. 9A) and a parylene polymer substrate, according to embodiments of the present invention.
Figure 9B:
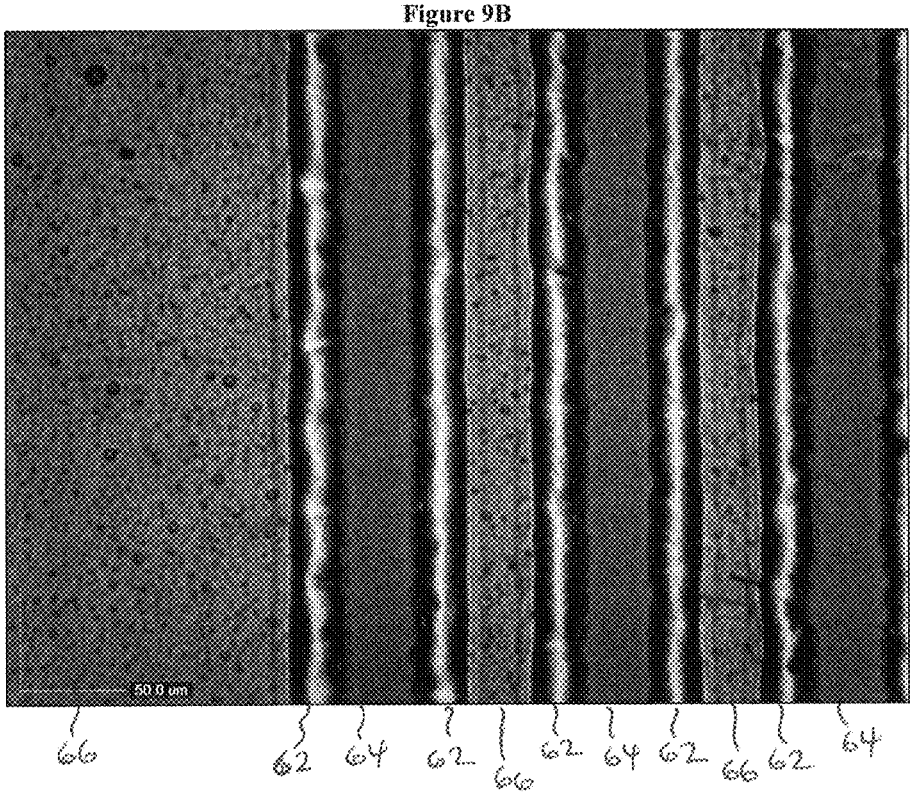
Figure 10:
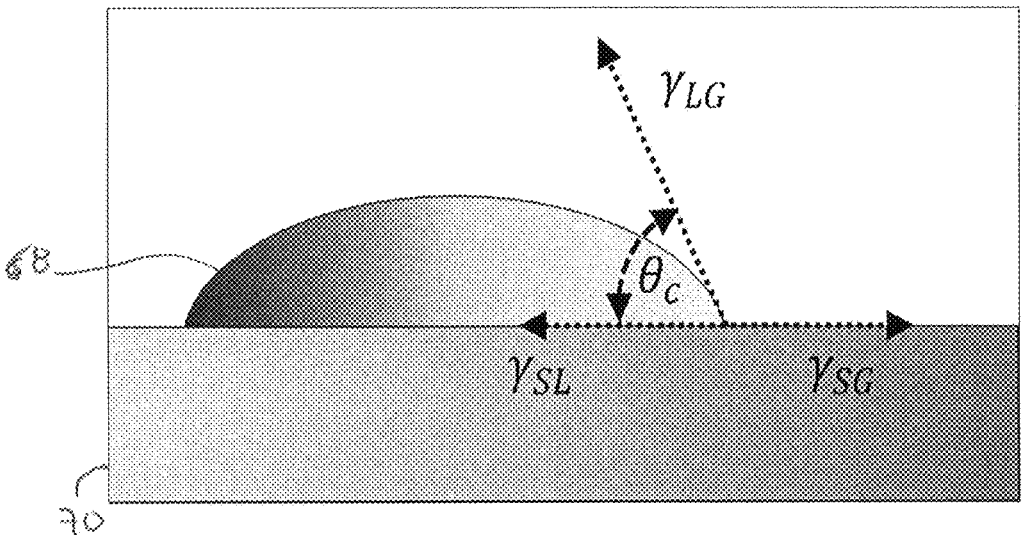
FIG. 10 shows a diagram of a liquid droplet on a surface.

The compatibility of different low-absorption substrates under the described selective dewetting process were demonstrated FIG. 9A demonstrates the ability to use a 1 mm borosilicate glass substrate in a selective dewetting writing process. Due to the relatively high melting temperature and the low absorption of the glass with respect to infrared (IR) laser radiation, the substrate was left unmodified by the laser radiation. The absorption layer consisted of 1.5 μm of Bismuth metal. FIG. 9B shows an example of the dewetting phenomenon using a 16 μm thick parylene-C polymer substrate in between the absorptive, 1.5 μm Bismuth, and the 1 mm borosilicate glass. In this case the polymer is parylene-C. Dewetting was clearly visible, even if the absorptive material solidified differently between the two substrates. The laser settings for both substrates were: 50 kHz, 5 μs, 10 W, 238 mm/s, cover gas at 80 SCFH. The lines are centered 110 μm apart.

Example 5: Basic Laser Directed Dewetting

Figure 2A:
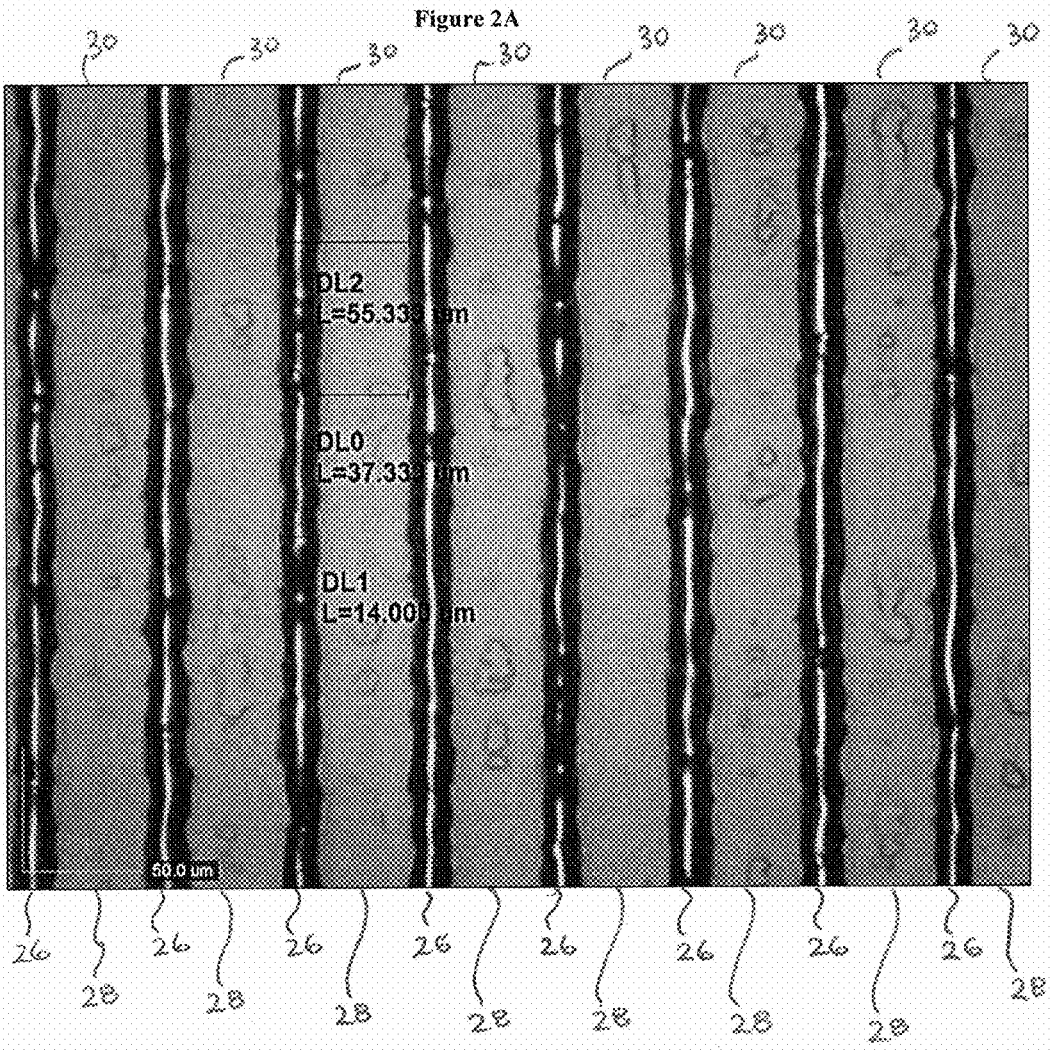
FIGS. 2A, 2B, and 2C show an array of dewetted lines according to an embodiment of the present invention, with the dewetted lines of FIG. 2A having a 55 μm spacing, FIG. 2B being a two-dimensional height map of the dewetted lines of FIG. 2A, and FIG. 3B being a three-dimensional height map of the dewetted lines of FIG. 2A.
Figure 2B:
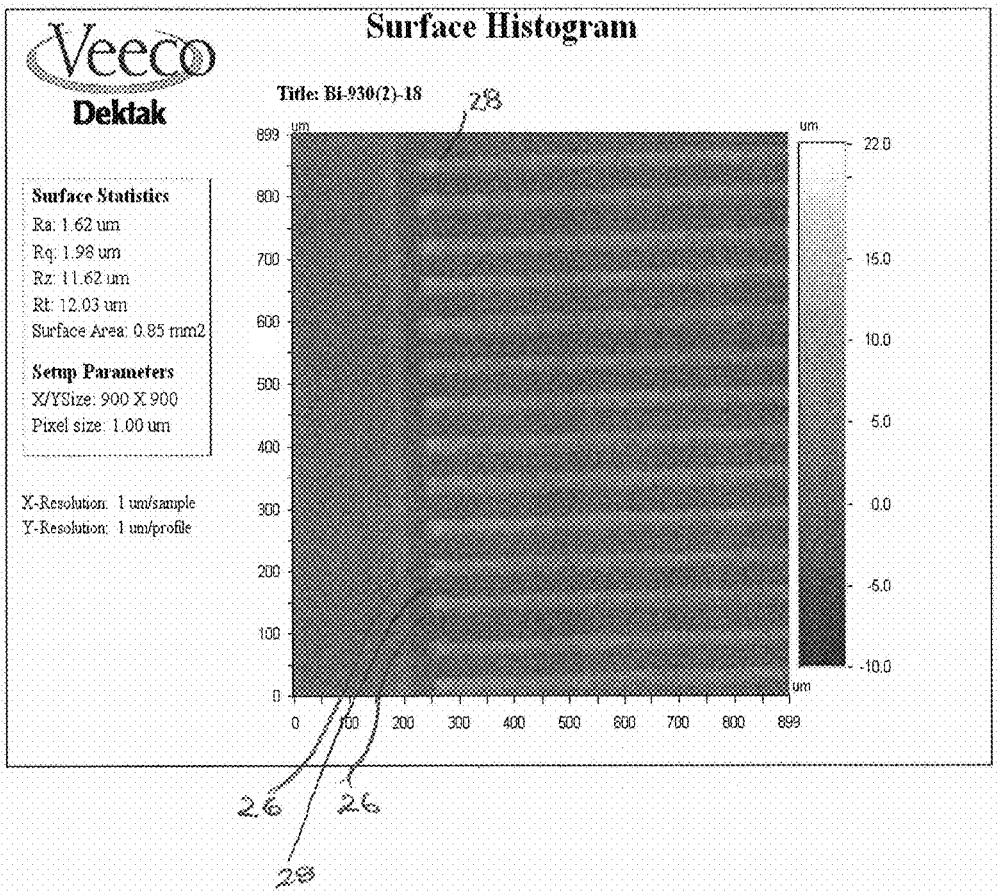
Figure 2C:
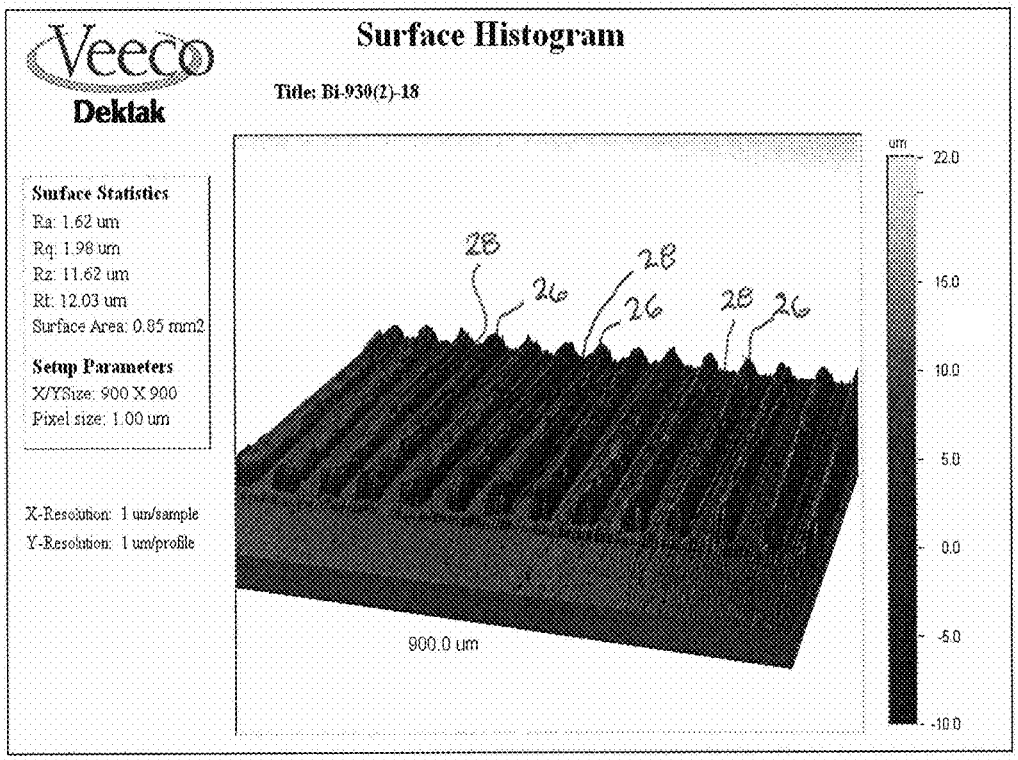

To explore the basic, laser-induced dewetting properties of bismuth (Bi), arrays of 150 μm wide dots 96 were deposited on uncoated glass slides and parylene-C (par-C) coated slides 98 (FIG. 2A). Bismuth metal was deposited in a dot-array pattern (not shown) using a masked, vapor deposition technique. Deposited dots 96 were centered 2.15 mm apart in a 9×13 dot array. Two such arrays were deposited upon each substrate. Substrates consisted of uncoated borosilicate glass microscope slides, as well as slides with a 22 μm thick deposited layer of par-C 98. Each dot 96 had a diameter measuring 130 μm. Dots 96 were deposited at three different thicknesses: 1000 nm, 2000 nm, and 4000 nm. As a result of shadowing effects from the masked deposition, each dot 96 exhibited excess deposited material outside of the 130 μm diameter. This excess material tapered down in thickness and extended out to a maximum diameter of 150 μm±2 μm. Exposure of the deposited dots 96 proceeded in a spiral pattern starting at an outer diameter of 300 μm and decreased with a spacing of 20 μm down to an inner diameter of 70 μm to ensure complete exposure of the deposited dots 96. The center of the spiral pattern and the center of the deposited dot 96 were aligned to within 10 μm. Laser settings were set at the standard laser parameters for bismuth (e.g., pulse frequency=50 kHz; pulse length=5 μs; power=10 W; scan speed=240 mm/s; positioning speed=240 mm/s; Ar gas flow=80 SCFH).

Figures 12A, 12B:
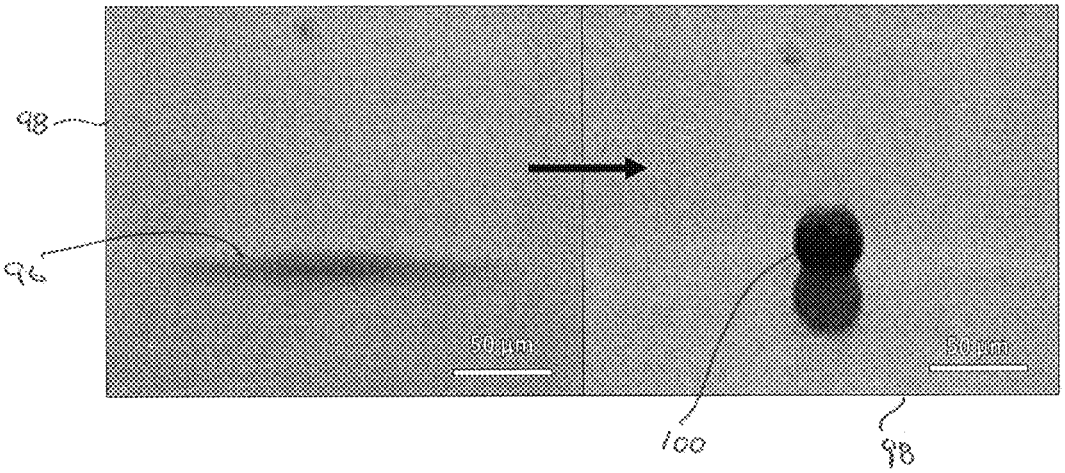
FIGS. 12A and 12B show a side view comparison of an as-deposited, 4000 nm thick bismuth (Bi) dot (FIG. 12A) and-a dewetted bismuth (Bi) dot (FIG. 12B) on a parylene-C coated borosilicate glass slide according to an embodiment of the present invention.

Beginning at a distance of 150 μm from the center of the dot 96, the beam was scanned in a spiral pattern along the surface of the deposited metal. Each complete turn along the spiral path brought the beam 20 μm closer to the center of the dot 96 until it reached a radius of 35 μm. As the laser spot progressed along the prescribed path, the light coupled with the metal induced melting and retraction into a single dewetted mass 100 located at the center of the spiral (FIG. 12B). Attempts to end the spiral path of the beam at smaller radiuses resulted in complete detachment of the dewetted mass, which was blown off the substrate by the flowing argon blanket. The radius of the dewetted mass 100 itself measured 18 μm wide when viewed from a top-down angle. This is notably smaller than the radius down to which the laser was scanned, but can be explained by the radius of the laser spot itself. The calculated laser spot diameter was 33 μm, which indicated that laser energy reached a distance from the dot center as small as 18.5 μm. A side-view of the dewetted mass revealed an almost-spherical geometry (FIG. 12B).

Figure 13A:
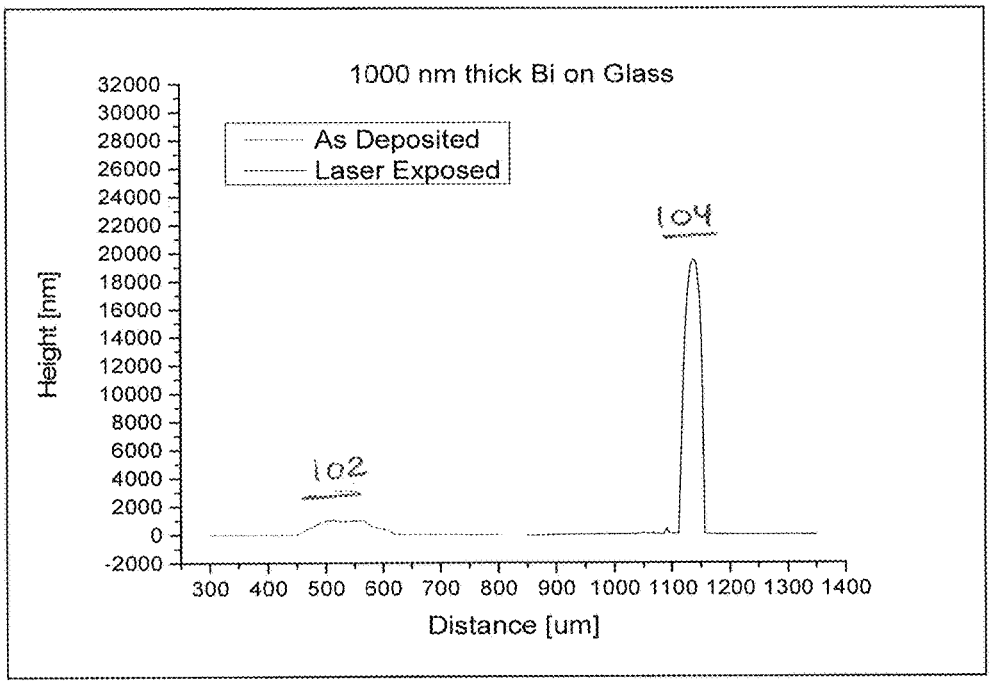
FIGS. 13A, 13B, 13C, 13D, 13E, and 13F show profilometry scans of dewetted dots under focused laser radiation according to an embodiment of the present invention, wherein the substrates consist of borosilicate glass microscope slides (FIGS. 13A, 13B, and 13C) and parylene-C deposited on glass (FIGS. 13A, 13B, and 13C)
Figure 13B:
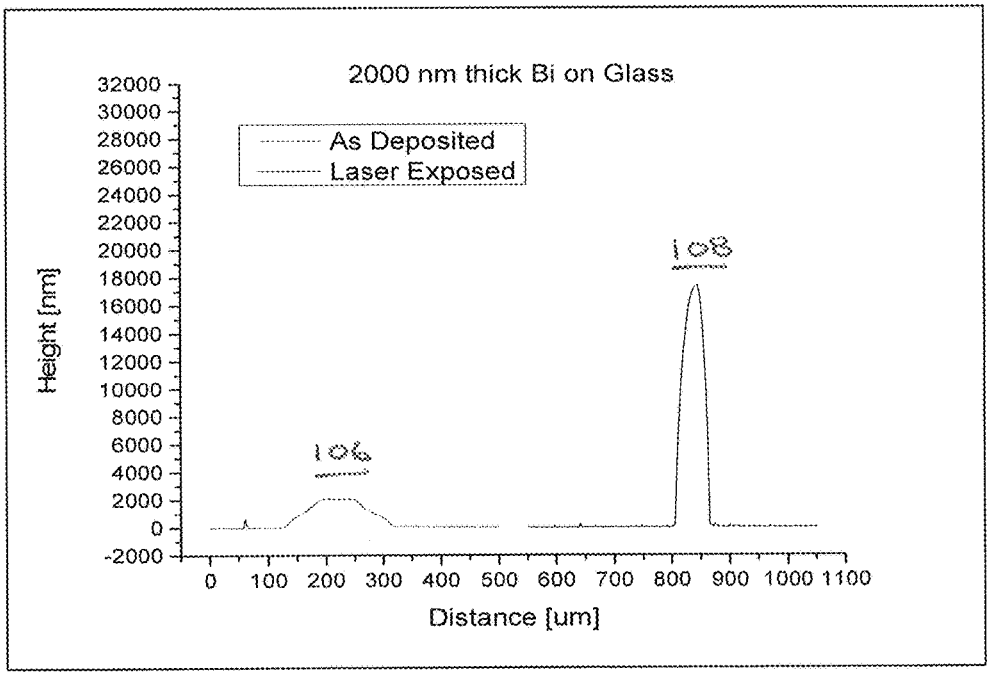
Figure 13C:
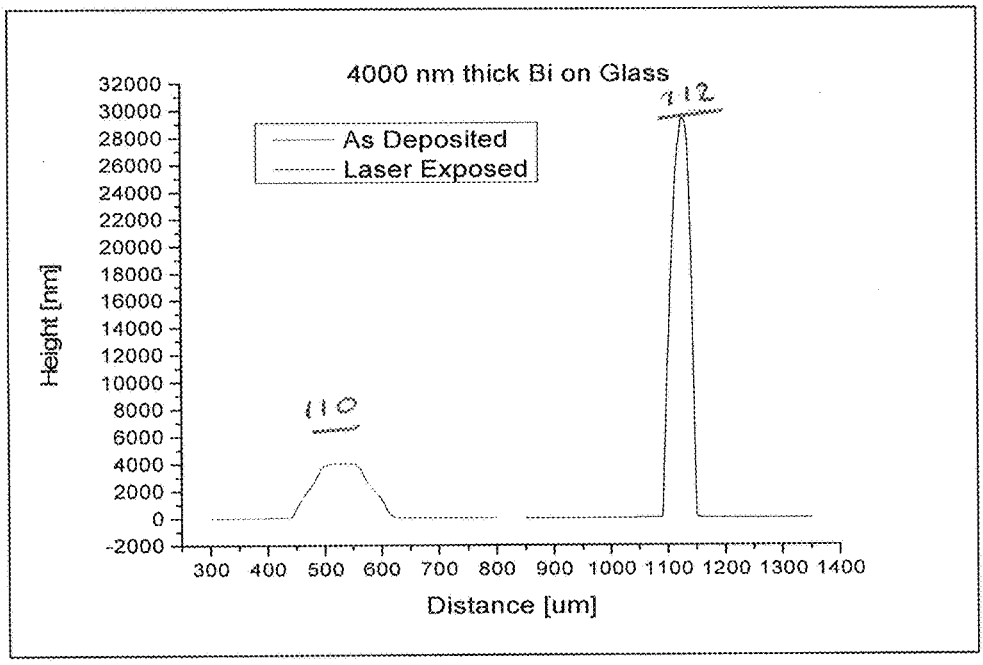
Figure 13D:
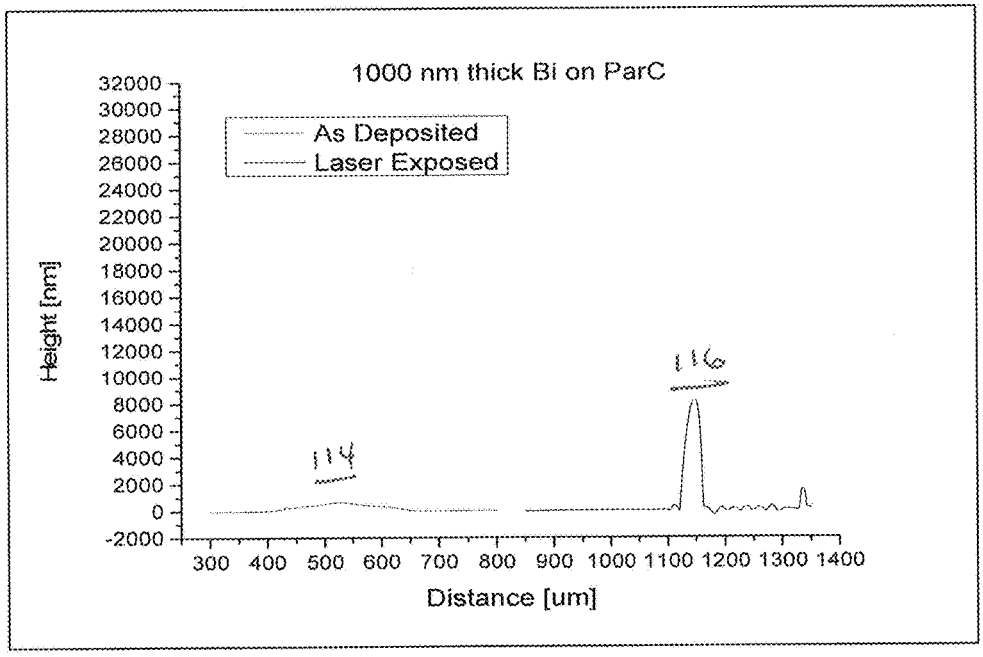
Figure 13E:
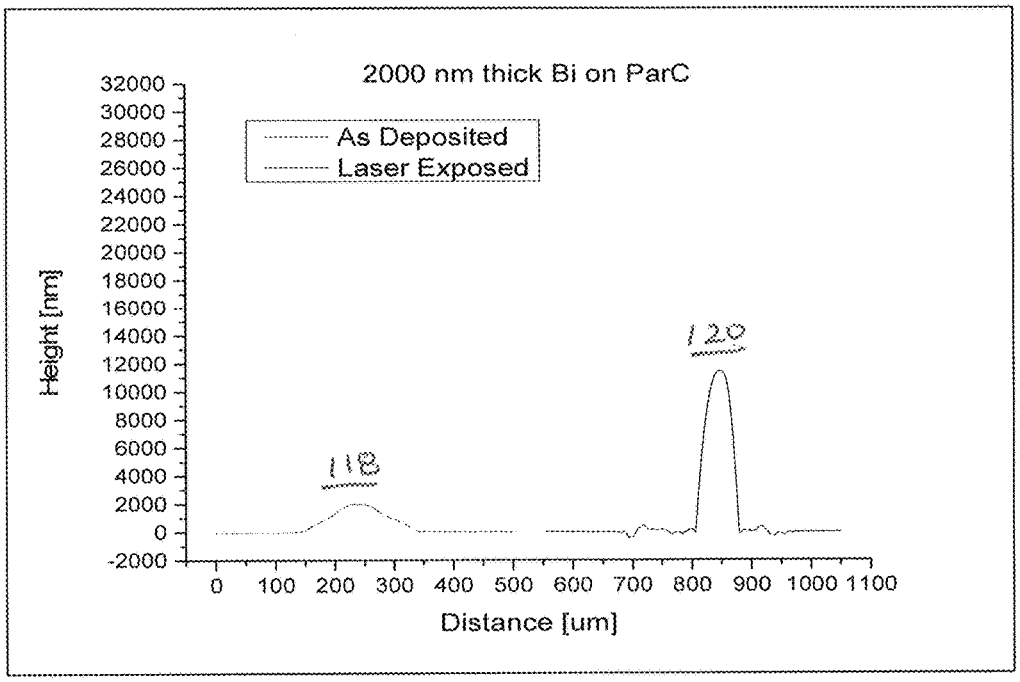
Figure 13F:
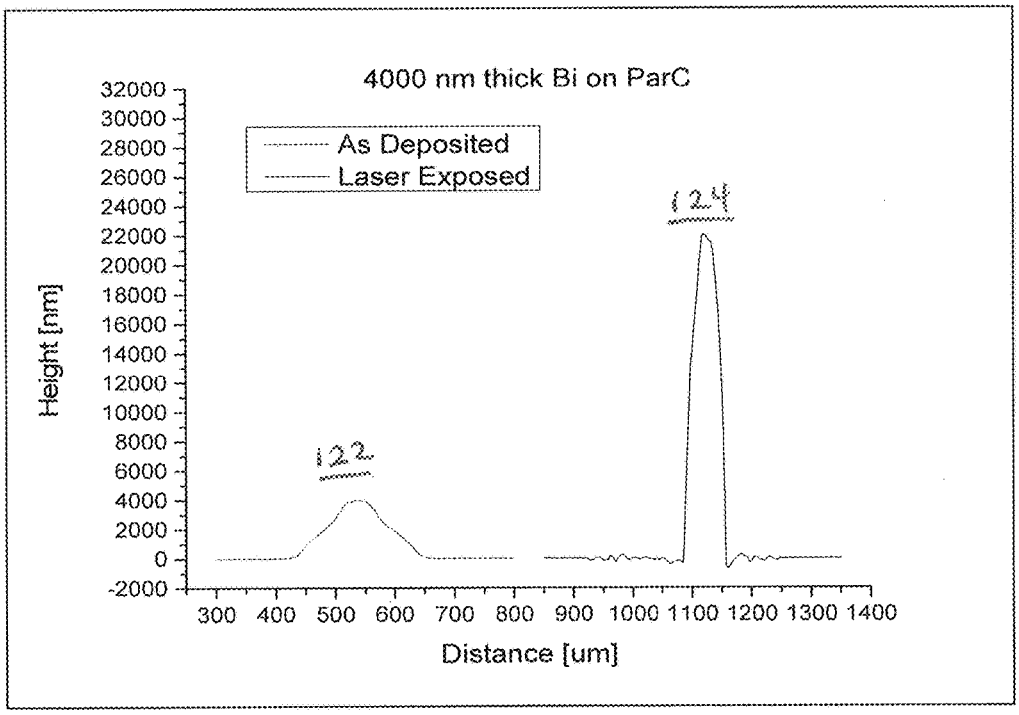

Profilometry measurements of the dewetted masses revealed the extent of dewetting via the difference in height between the "as deposited" 102, 106, 110, 114, 118, 122 and the "laser exposed" 104, 108, 112, 116, 120, 124 conditions of the dots (FIGS. 13A, 13B, 13C, 13D, 13E, 13F). For dots deposited upon uncoated borosilicate glass, the resulting heights in the dewetted mass did not systematically increase with the as-deposited thickness. Dots deposited at 1000 nm, 2000 nm, and 4000 nm dewetted to heights of 19500 nm, 17500 nm, and 29250 nm respectively (FIGS. 13A, 13B, and 13C). When deposited on par-C coated slides, the measured heights held a systematic, positive correlation with volume increase. Dots deposited at 1000 nm, 2000 nm, and 4000 nm dewetted on par-C to heights of 8750 nm, 11500 nm and 22000 nm respectively (FIGS. 13D, 13E, and 13F).

Example 6: Simple Dewetting Geometry

Line Arrays

Features organized into parallel lines represent a fundamental geometry in modern electrode and electronics design. Viable patterning techniques must be able to accurately and reproducibly create such structures out of the target material. To this end, an array of isolated, parallel lines were dewetted from Bi thin film deposited on 1 mm borosilicate glass slides coated with par-C as a substrate, as well as from tin thin film deposited on 1 mm borosilicate glass slides coated with par-C as a substrate.

Figure 1A:
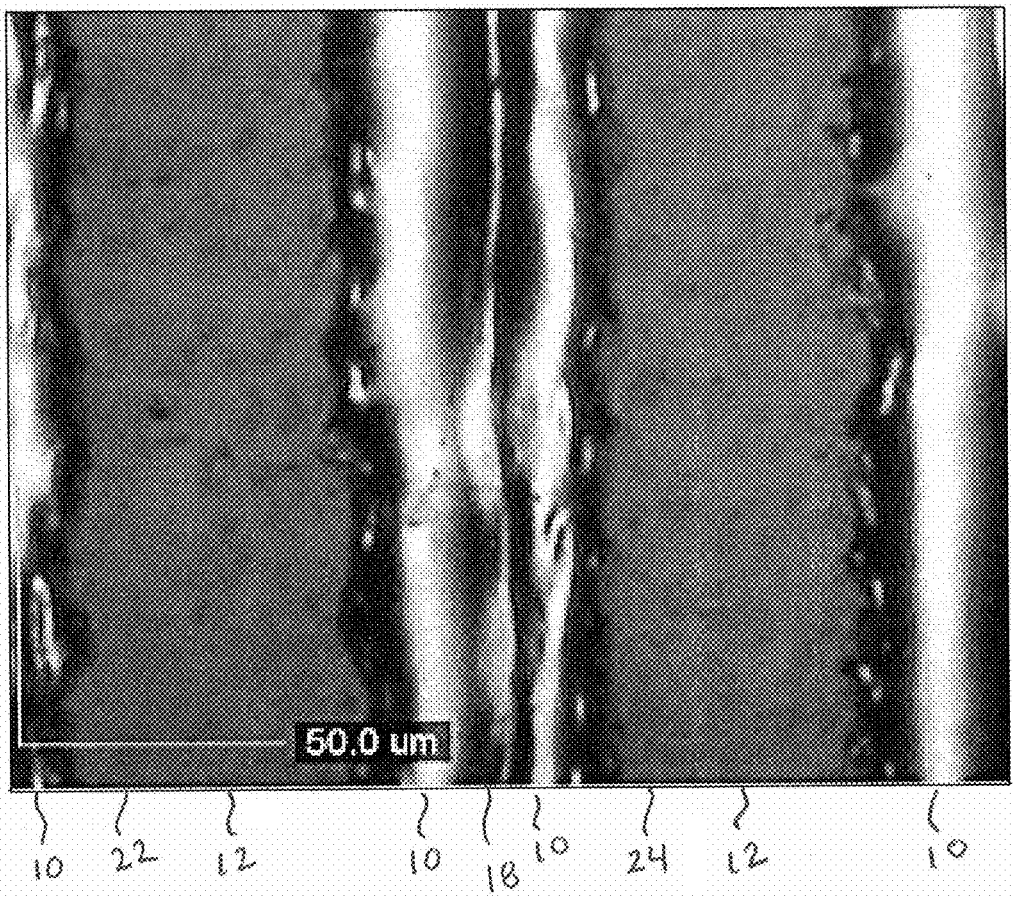
FIGS. 1A, 1B, 1C, and 1D show two examples of dewetting lines according to embodiments of the present invention, with the dewetting lines of FIG. 1A being 100 μm apart, the dewetting lines of FIG. 1B being 125 μm apart, Figure C being a profile of the dewetting lines of FIG. 1A, and Figure D being a profile of the dewetting lines of FIG. 1B.
Figure 1B:
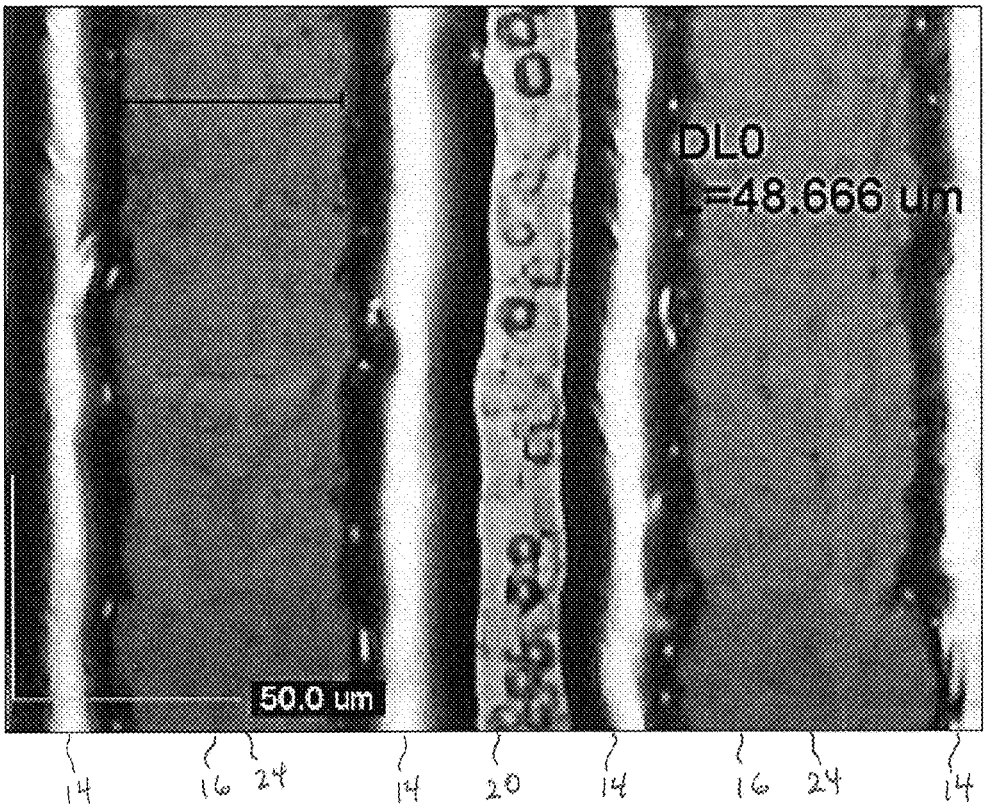
Figure 1C:
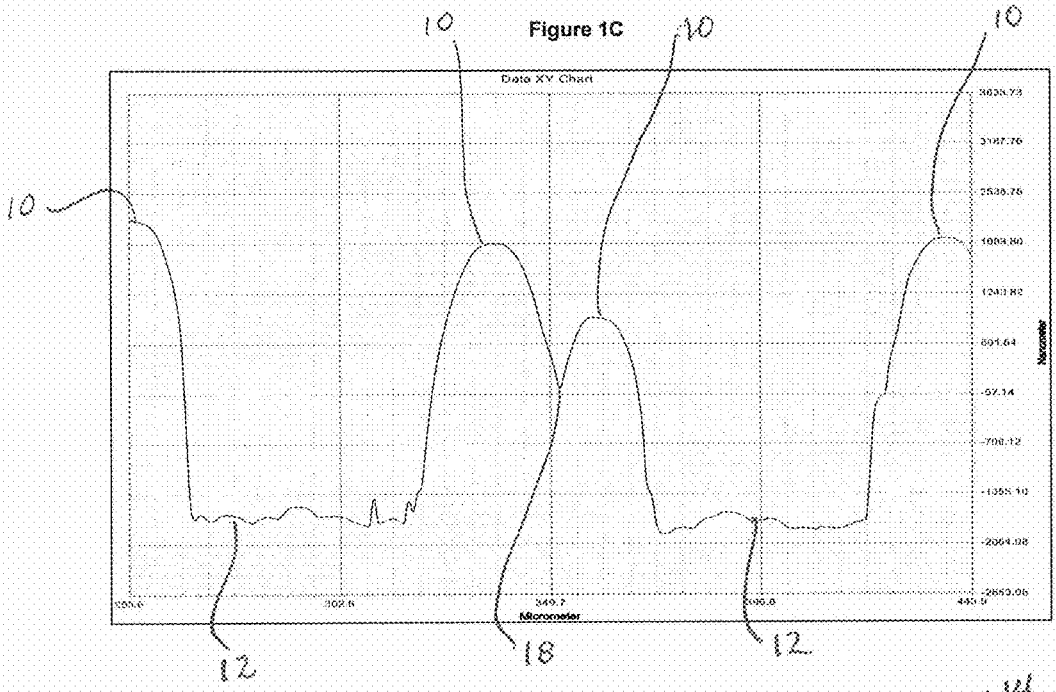
Figure 1D:
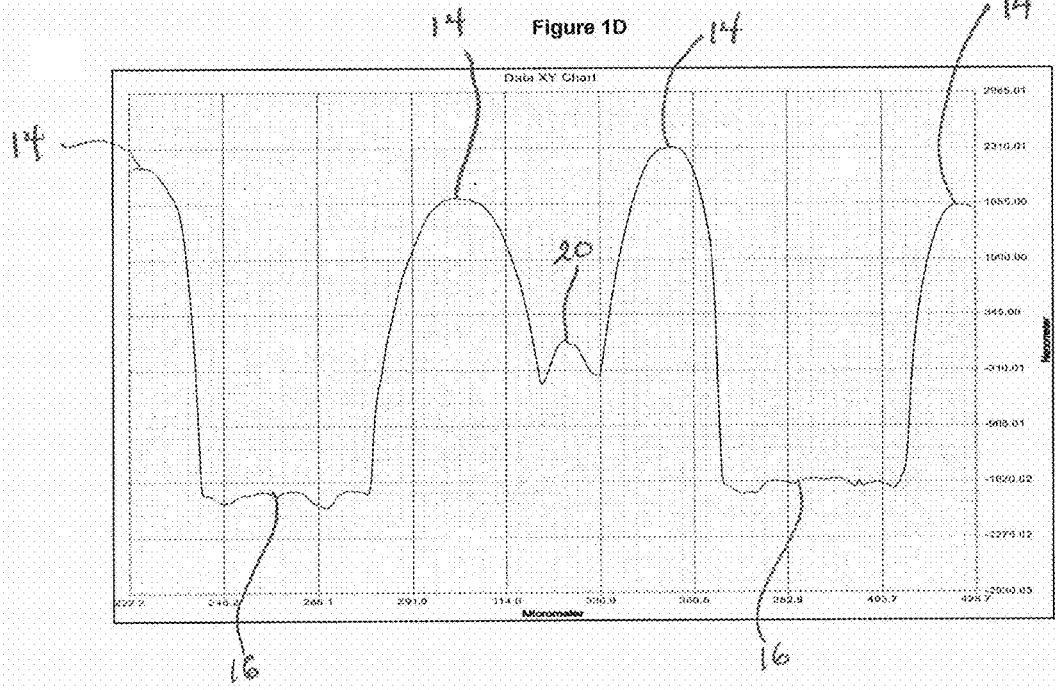

Tests on 1500 nm bismuth metal coated substrates fabricated by thermal evaporation demonstrated the laser system's ability to construct isolated lines of dewetted metal. FIGS. 1A and 1B show isolated lines 10, 14 of material created by dewetting areas 12, 16 on either side. The lines 10, 14 were constructed using a 10 W pulsed beam at 50 kHz, a pulse length of 5 μs, and a speed of 350 mm/s. A noble-gas cover blanket (argon) was flowed over the material at 80 SCFH. The centers of the dewetted lines 12, 16 were spaced at 100 μm (FIG. 1A) and 125 μm (FIG. 1B) respectively with a beam spot diameter of 40 μm. In both examples, the absorption layer 18, 20 consisted of bismuth with a thickness of 1.5 μm. The low-absorption substrates consisted of 16 μm of deposited parylene-C polymer 22, 24 on top of a 1 mm thick borosilicate glass slide.

Use of the scanner head allowed for the creation of arrays of lines with user-defined spacing. Laser parameters were set such that the pulse overlap was sufficient to dewet enough material between the lines to ensure electrical isolation. To verify this, resistance measurements were taken with an Agilent 34410A Digital Multimeter. All lines with a pulse overlap percentage above 45% showed resistance values equivalent to an open circuit (displaying "overload">>G-Ohm), indicating that there was no residual material between adjacent lines to allow any appreciable electrical conduction. The laser parameters were as follows: 50 kHz, 5 μs, 10 W, 350 mm/s, cover gas at 80 SCFH. Lines were centered 55 μm apart. The sample consisted of a 1.5 μm thick layer of Bismuth on top of 16 μm of parylene-C polymer with a 1 mm thick borosilicate glass substrate.

Bi films measuring 1.6 μm thick deposited on 1 mm borosilicate glass slides coated with between 25 and 30 μm of par-C as a substrate were exposed to laser radiation in a set of line arrays. Exposure conditions mirrored the general laser parameters for bismuth films under focused conditions (e.g., pulse frequency=50 kHz; pulse length=5 μs; power=10 W; scan speed=240 mm/s; positioning speed=240 mm/s; Ar gas flow=80 SCFH). The substrate was oriented with the metallic film facing the scan lens, which is characterized as a "front-side" dewetting condition. Each array encompassed the area of a 2 mm×2 mm square. Spacing between individual lines within the arrays measured as large as 200 μm and were incrementally decreased down to a pitch of 55 μm for bismuth films.

Tin films also were exposed in line array patterns in similar fashion. Specifically, tin films measured 1.6 μm in thickness and were deposited on 22 μm par-C/1 mm borosilicate glass substrates. Scanning and positioning speed were set at 100 mm/s. Line arrays were scanned using various pitches ranging from 200 μm down to 75 μm. Exposure settings mirrored the general laser parameters for tin films, which were identical to those for bismuth films, with the exception of the scan and positioning speeds. For tin films, line arrays with a pitch of 100 μm were further processed under defocused laser conditions. A defocused beam spot 150 μm in diameter, as measured by marks made on target films, was created by lowering the holder 10 mm below the focal plane of the lens. The laser operated at 10 W, 10 kHz, with pulse durations of 40 μs. The beam scanned at 1400 mm/s, which resulted in a pulse overlap calculated at 34%. Overlap was minimized to prevent over exposure and uncontrolled, random dewetting of the film.

Figures 14A, 14B:
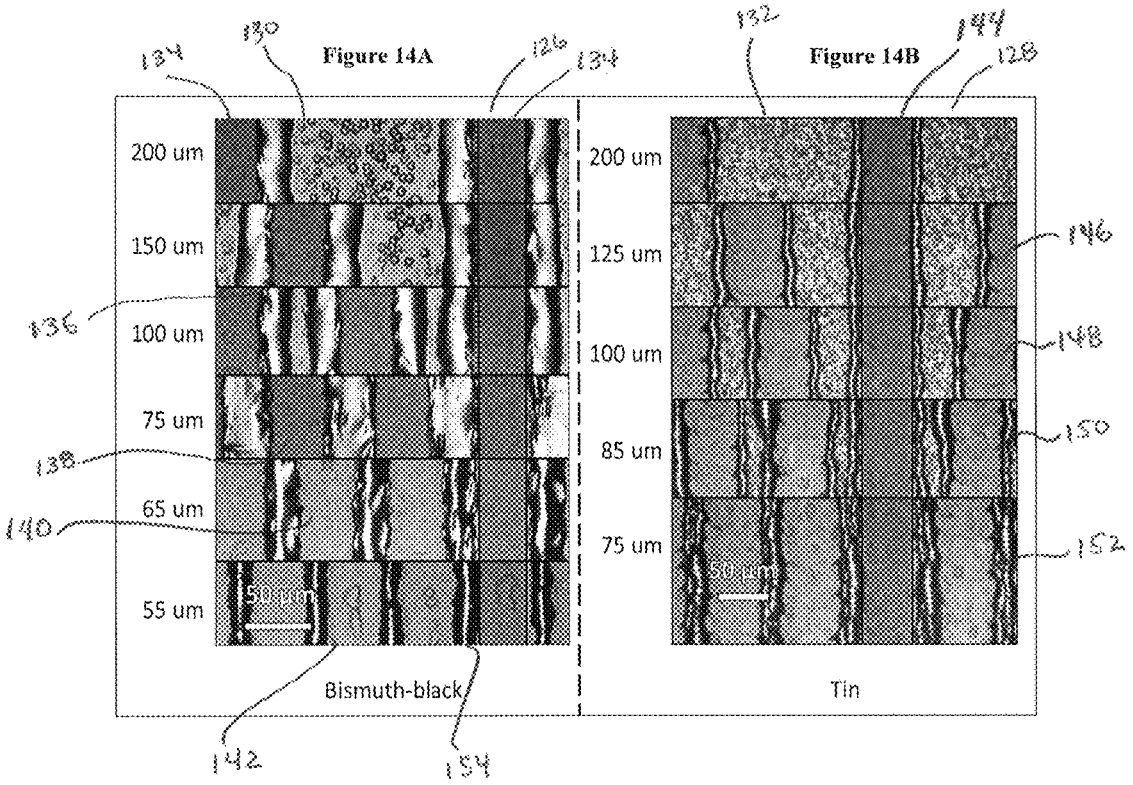
FIGS. 14A and 14B show optical microscope images of bismuth line arrays (FIG. 14A) and tin line arrays (FIG. 14B) according to embodiments of the present invention, set at different line pitches.
Figure 15A:
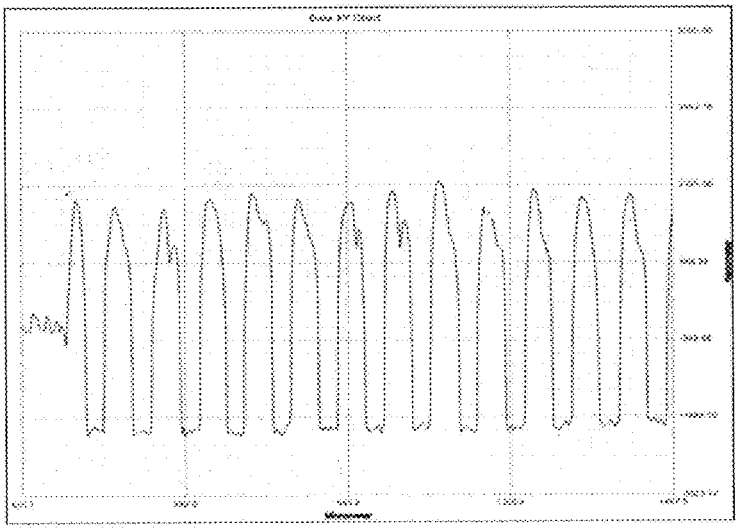
FIGS. 15A, 15B, and 15C show a line array dewetted from 1.6 μm thick bismuth under focused conditions according to an embodiment of the present invention, with the lines set at a pitch of 75 μm, measured center to center, and having an average thickness of 3.85 μm, wherein characterization of the line array was conducted using profilometry (FIG. 15A), optical microscopy (FIG. 15B), and field emission scanning electron microscopy (FESEM) (FIG. 15), the platelet structures of FIG. 15C being silver (Ag) from the conductive epoxy used for FESEM preparation, and dewetted bismuth (Bi) being indicated in FIG. 15C by the white arrows.
Figure 15B:
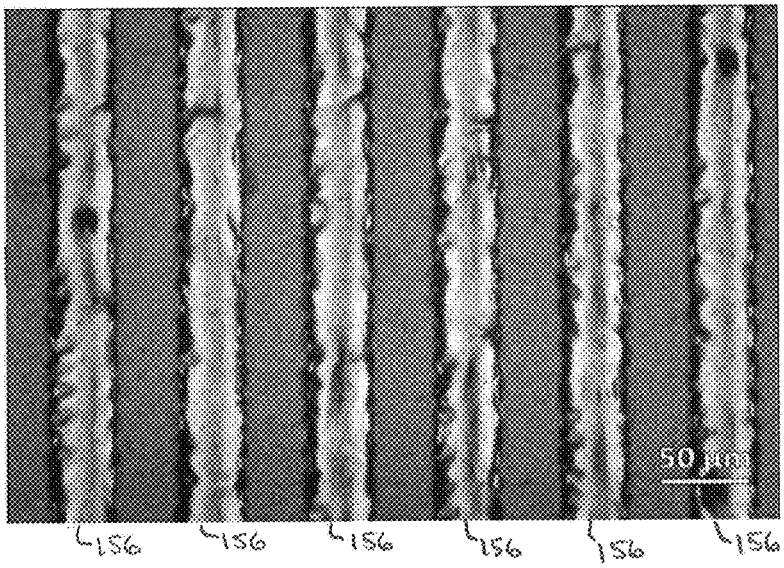
Figure 15C:
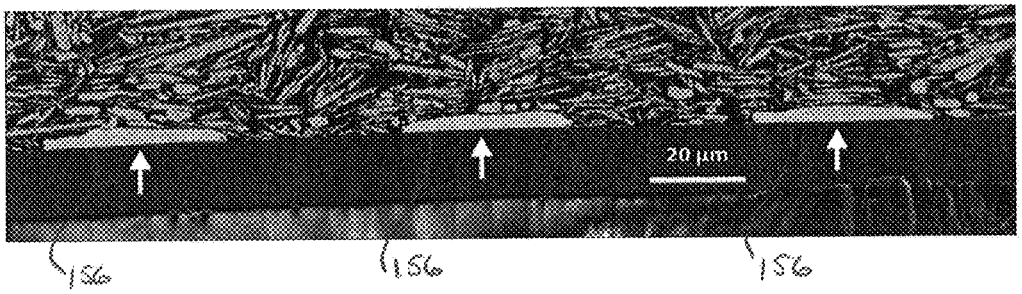
Figure 16A:
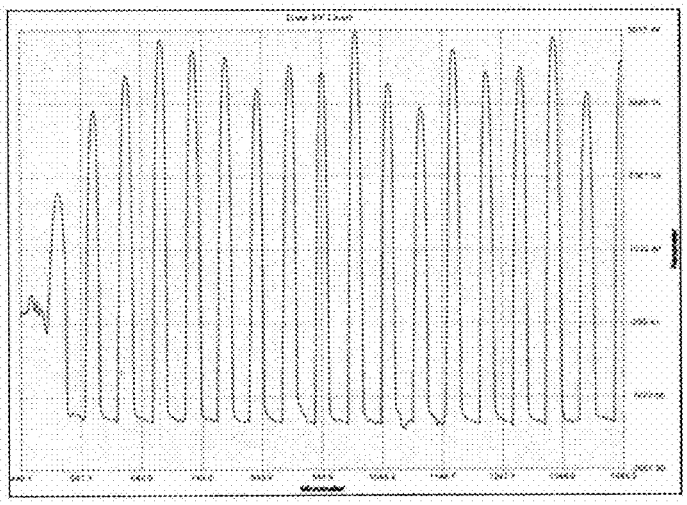
FIGS. 16A, 16B, and 16C show a line array dewetted from 1.6 μm thick bismuth under focused conditions according to an embodiment of the present invention, with the lines set at a pitch of 55 μm apart, center to center, with an average height of 6.67 μm, wherein characterization of the line array was conducted using profilometry (FIG. 16A), optical microscopy (FIG. 16B), and field emission scanning electron microscopy (FESEM) (FIG. 16 C), dewetted bismuth (Bi) being indicated in FIG. 16C by the white arrows.
Figure 16B:
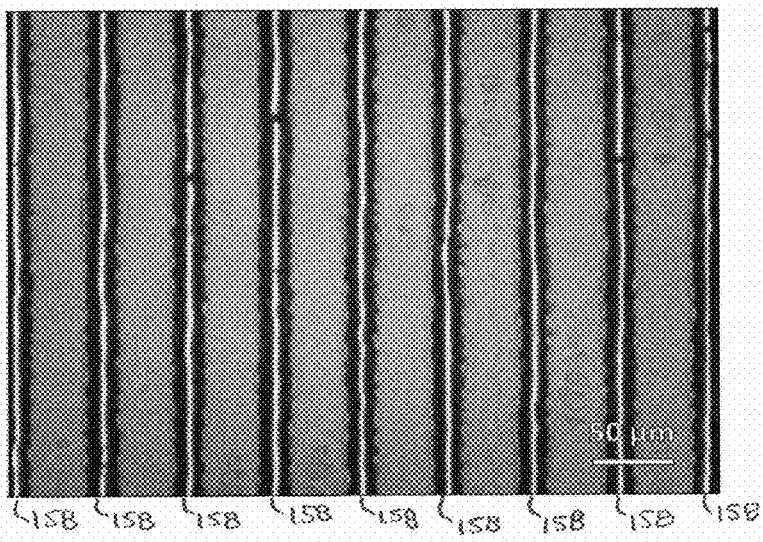
Figure 16C:
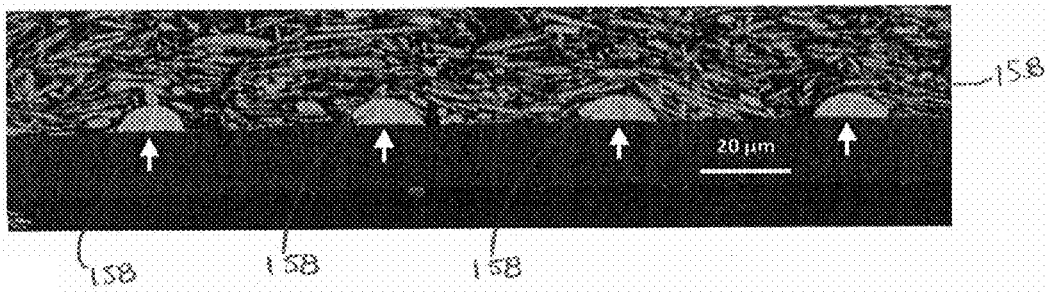

Each pass of the laser created an area of exposed substrate. Dewetted metal gathered along the edges of the exposed area, to create a dewetted bead. Height measurements of the dewetted bead showed a marked increase in the metal thickness compared to the original layer thickness. Profilometry measurements placed the height of the dewetted bead at 3.4 μm as measured from the substrate, which represented a 113% increase in the local thickness of the film. FIGS. 14A and 14B display line arrays 126, 128 created using both bismuth 130 and tin 132 films. Lines 134, 136, 138, 140, 142, 144, 146, 148, 150, 152 were created at various pitches, yet the areas of exposed substrate remained the same widths due to a consistent beam spot diameter. Without being bound by theory, a single laser pass was assumed to distribute an equal amount of dewetted material to both sides resulting in each bead being comprised of half the material dewetted from an individual laser pass. With a height of 3.4 μm and a width of 25 μm, the height to width aspect ratio of a single dewetted bead 154 in the bismuth film was calculated as 0.13:1.0. Dimensions of the dewetted beads remained relatively constant until line pitch decreased down to 75 μm. Profilometry data (FIG. 15A) showed that when line pitch was set at 75 μm on a bismuth film (not shown), the dewetted beads made from adjacent laser passes combined into a single 3.85 μm thick, 35 μm wide bead 156. Further reduction in pitch down to 55 μm resulted in a single 6.67 μm thick, 14 μm wide bead 158 (FIGS. 16A, 16B, 16C). Aspect ratios of the 75 μm and the 55 μm spaced line arrays were 0.11:1.0 and 0.48:1.0 respectively. Further characterizations of the line arrays by scanning electron microscope confirmed these measurements (FIGS. 15B, 15C, 16C, 16D).

Figure 17:
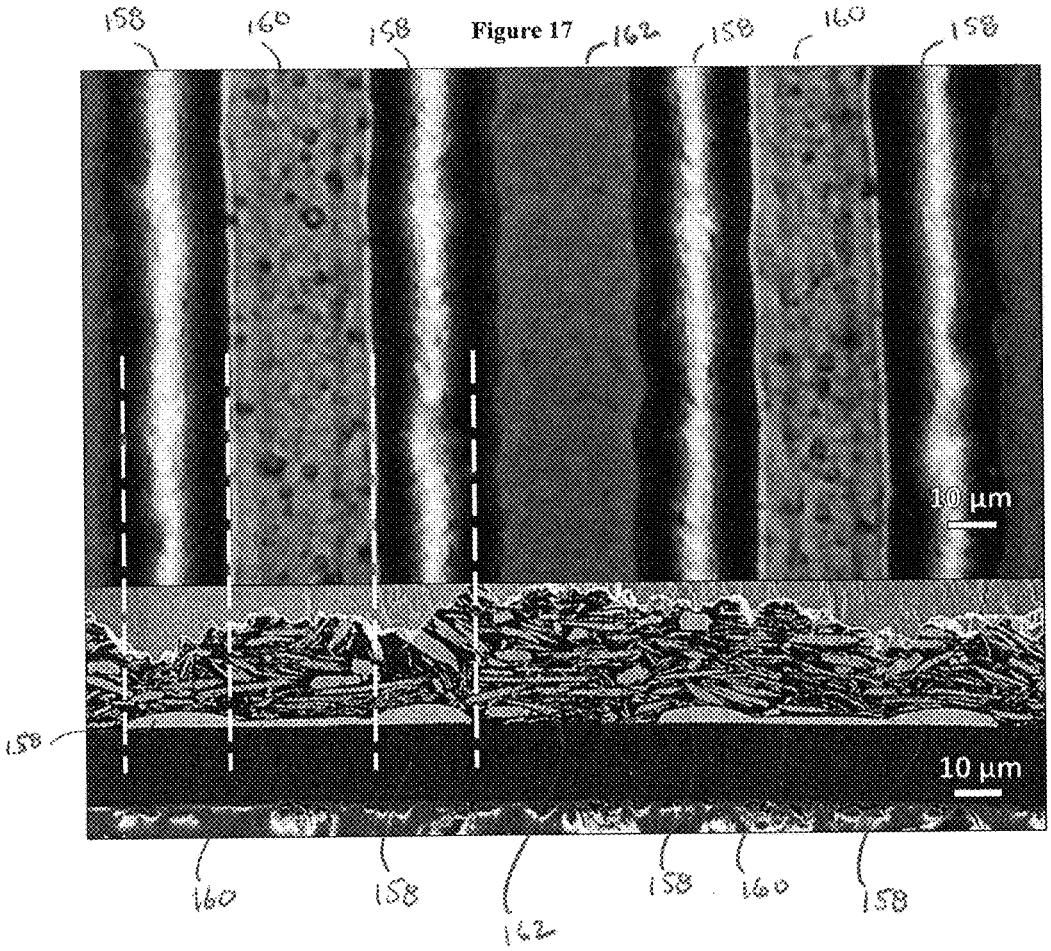
FIG. 17 shows an electron microscope cross-section of dewetted edges of a line array created, according to an embodiment of the present invention, with a 100 μm spacing distance, aligned with a top down view of the line array, wherein the dashed lines highlight the raised, dewetted beads and the connecting film in between, and the platelet structures are silver (Ag) from the conductive epoxy used in sample preparation.

For those line arrays with line spacing larger than 75 μm, each dewetted bead remained detached from one another. The cross-sections for these types of line arrays showed an area of exposed substrate with no obvious residual film bordered on both sides by two dewetted beads created from the film that once filled the space. Beyond the two beads were areas of as-deposited film, which were followed by a second pair of dewetted beads created from adjacent laser passes. FIG. 17 shows such cross-sections, where beads 158 from adjacent laser passes are connected by a section of as-deposited film 160. In FIG. 17, the white dash-lines are used to identify equivalent structures as seen from both a top-down angle and a cross-sectional perspective. In this respect, these structures 158, 160 form channels. Without being bound by theory, these types of line arrays could be useful in microfluidics applications as they effectively form micro-channels of conductive material.

Figure 18:
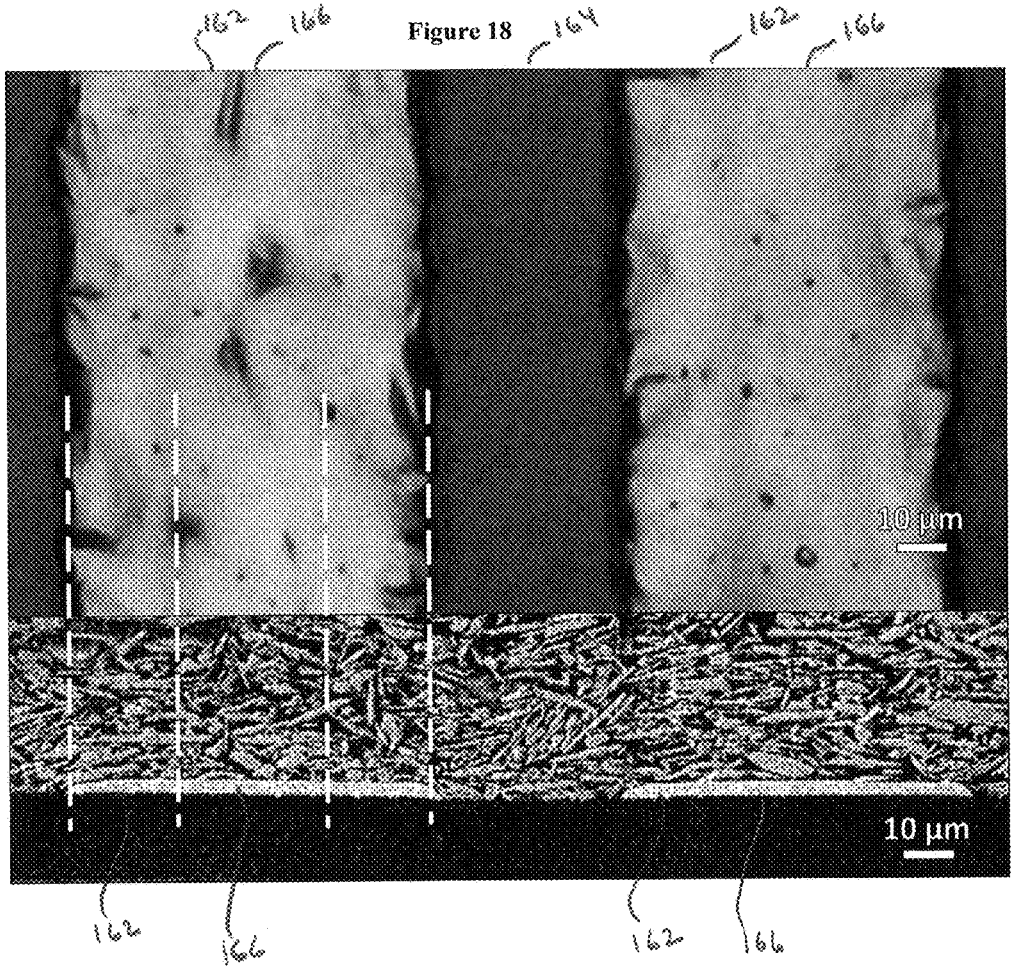
FIG. 18 shows defocused exposure re-processing of the 100 μm pitch features of FIG. 17, wherein the line arrays result in a uniform height profile, and the dashed lines mark where dewetted beads previously existed as shown in FIG. 17.

Turning to FIG. 1B, defocused reprocessing conditions led to an annealing effect on the dewetted beads, resulting in a smooth cross-section. Initially, beads 162 measured 3.4 μm in thickness. As the beads 162 melted, they recombined with each other by flowing over the as-deposited section of film 166 that connected them. In direct comparison to the cross-sections in FIG. 17, the re-melted features 162, 166 in FIG. 18 exhibit a uniform cross-sectional height. White dash-lines demark the former locations of the dewetted beads. Inspection of the re-processed features showed a decrease in thickness in the former locations of the dewetted beads with a corresponding increase in thickness in the former as-deposited area. Profilometry scans revealed that the 3.4 μm thick beads were melted and flowed into the 1.6 μm connecting film-section to form wide, uniform lines that measured 2.6 μm thick.

Material Retention

Figure 19A:
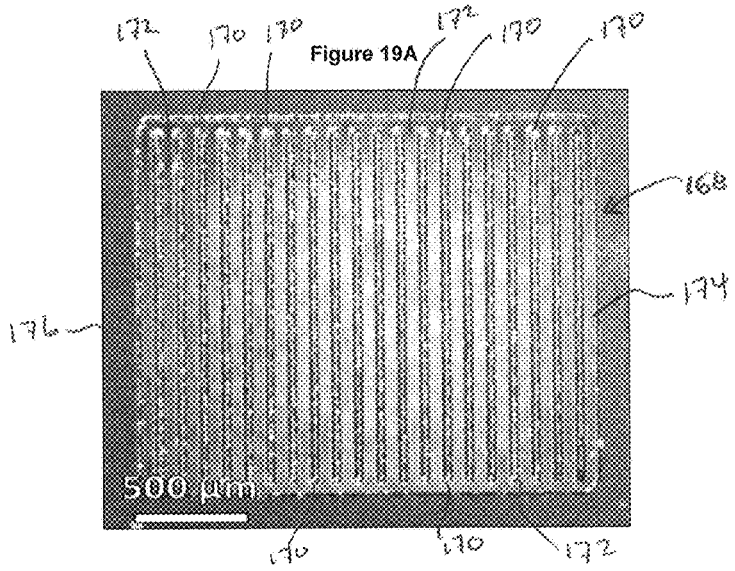
FIGS. 19A, 19B, 19C, and 19D show an optical image (FIG. 19A) and a field emission scanning electron microscopy (FESEM) image (FIG. 19B) of a self-contained line array measuring 2 mm×2 mm, prepared according to a method of the present invention, a three-dimensional height map of the dewetted line array (FIG. 19C) prepared from a profilometer scan of the dewetted line array, and an illustration (FIG. 19D) of a volumetric analysis performed on data from the images, which reveals a 0.5% discrepancy between the displaced positive and negative volumes, suggesting minimal material loss.
Figure 19B:
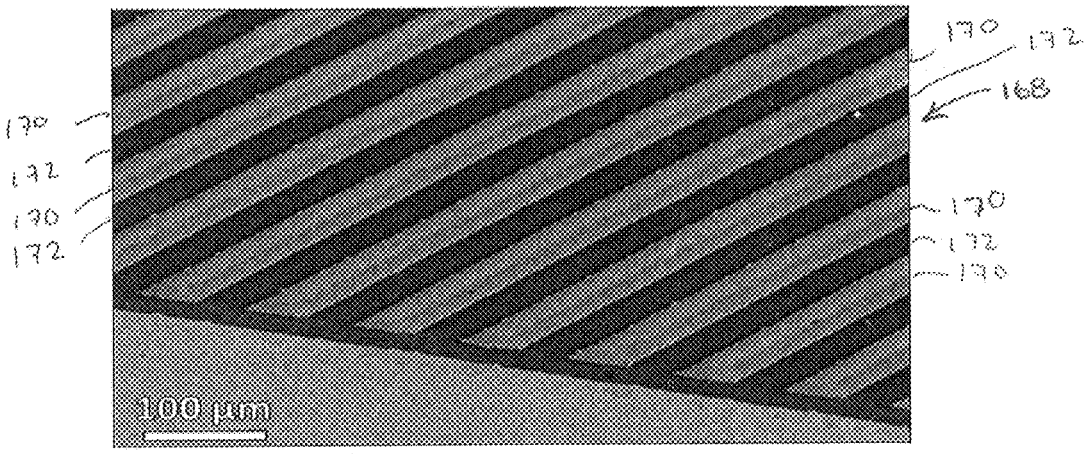
Figure 19C:
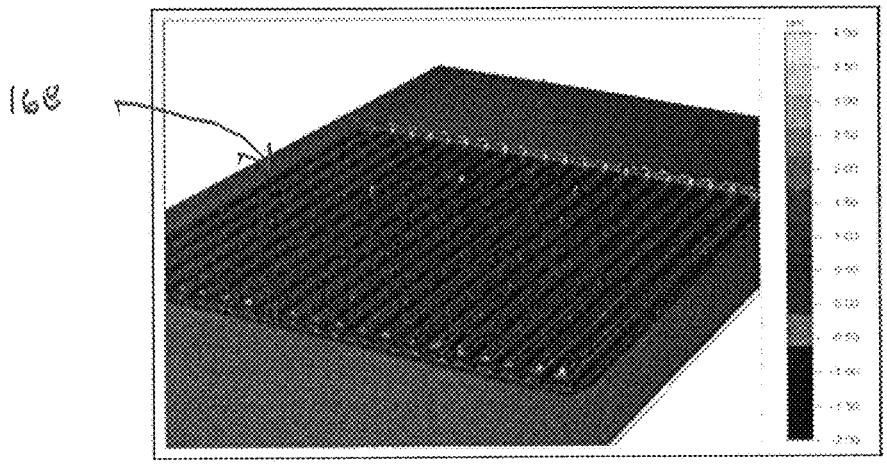
Figure 19D:
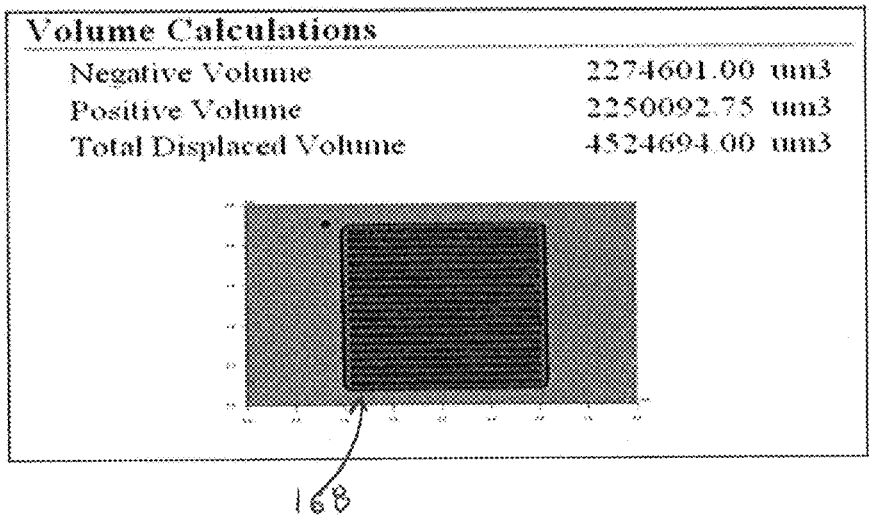

In this study, profilometry was used to establish an accounting of the material volume before and after analysis and thus establish whether significant metal ablation occurred. Referring to FIGS. 19A, 19B, 19C, 19D, an accounting of the displaced volume of a dewetted line array 168 was conducted using a Dektak profilometer. A 3.9 mm×2.5 mm area encompassing a line array with a pitch of 100 μm was scanned using the profilometer to create a 3D map. The line array itself 168 measured 2 mm×2 mm. Height sampling of the array 168 was set such that individual readings were spaced one micron (1 μm) apart in both the X and Y directions. Volumetric analysis was conducted using Dektak's Veeco data analysis program (FIG. 19D). Baseline was taken as the film surface, with measurements above and below baseline designated as positive and negative respectively. For example, a process that conserves the material completely would result in positive and negative volume measurements cancelling out.

An isolated array of lines 172 was scanned into a 1.6 μm thick Bi film 174 deposited upon a par-C coated borosilicate glass slide 176. The par-C layer measured 25 μm thick. General lasing parameters for Bi were used as described in Examples 5 and 6. The entire array 168 measured 2 mm×2 mm and had a line pitch of 100 μm. Using successive, adjacent profilometer scans, a 3D model of the area was formed and analyzed (FIG. 19C). Based on profilometer scanning, it was determined that a total of $4.52\times10^6$ $\mu m^3$ of material was displaced from the baseline (FIG. 19D). Of this volume, only $2.45\times10^4$ $\mu m^3$ or 0.5% of the displaced volume was unaccounted. This amount of unaccounted material falls within the measurement error of the profilometer and indicated minimal loss of the material into the vapor stream. Notably, the entire line array 168 took 0.316 seconds to complete; with much of this time spent on timing delays between marking and mirror-positioning steps. These results suggest that for geometries that feature large amounts of mirror re-positioning, the majority of the processing time is spent accommodating delays between scanner command signals, mirror reaction times, and laser activation timing. Such timing delays can be reduced by improvement of the galvanometer motors to which the mirrors are mounted as well as further optimization of the marking protocols and geometries within the scanner software.

Back-Side Exposure

Figure 11A:
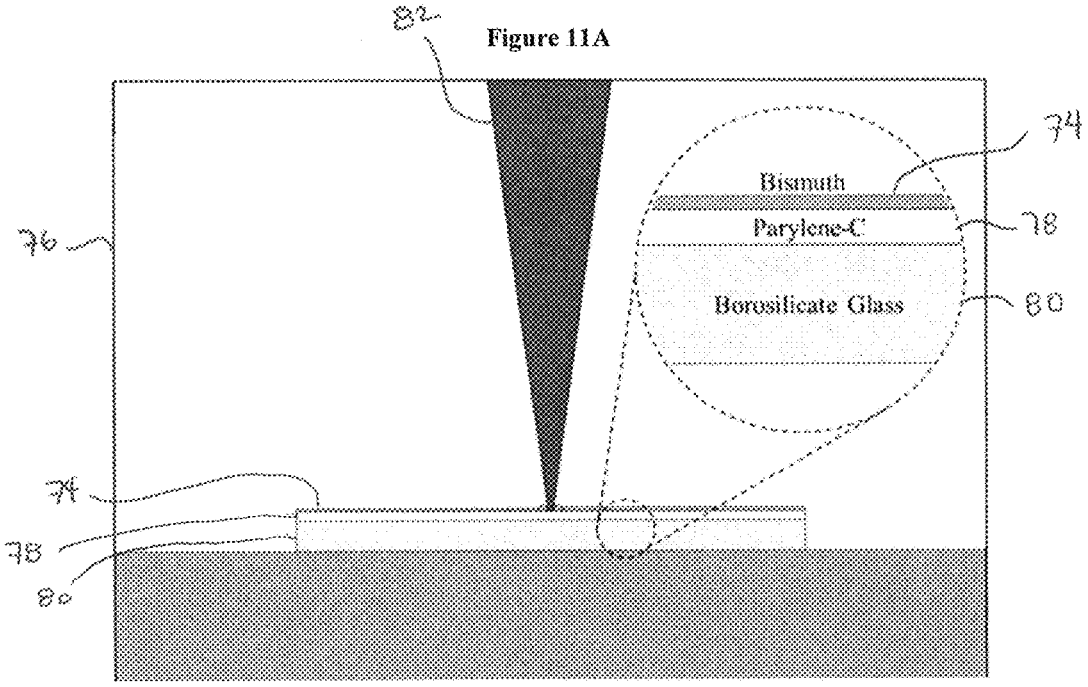
FIGS. 11A and 11B are schematic diagrams illustrating that transparency of a substrate to NIR laser light allows for front-side dewetting (FIG. 11A) and back-side dewetting (FIG. 11B) of the target metal material as demonstrated in FIGS. 8A and 8B.
Figure 11B:
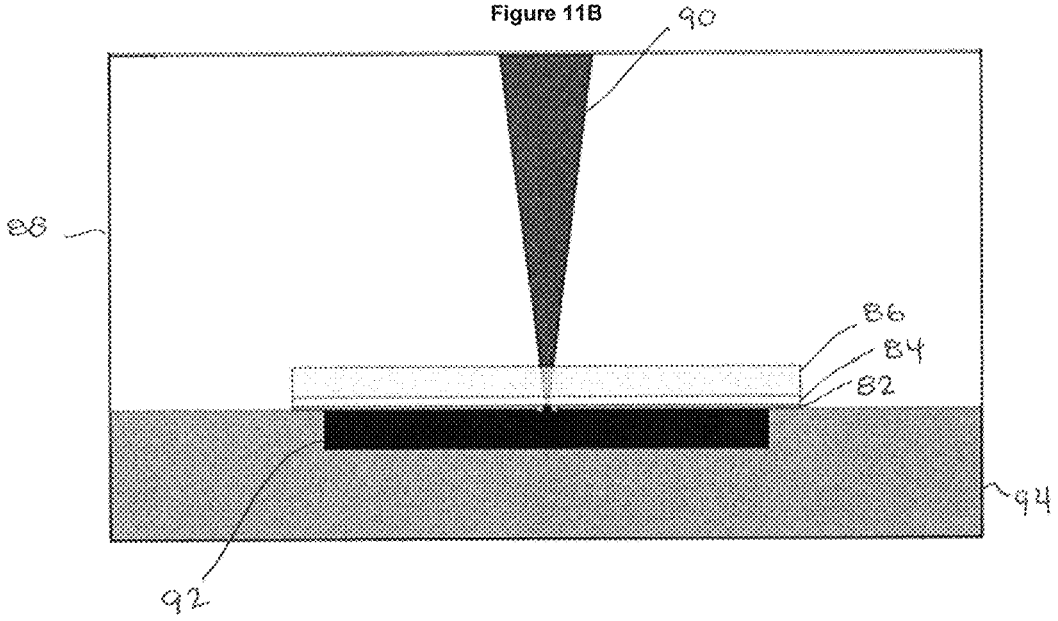

Front-side" dewetting of thin films refers to the exposure of the bismuth layer 74 through the Ar gas blanket 76 (FIG. 11A). In studies assessing the waveguide properties of par-C, transmission in the 1000 nm to 1500 nm range through a 15 μm thick sample was cited as 85%; the rest of the radiation is either absorbed or reflected [Jeong, Y. S., et al., "UV-visible and infrared characterization of poly(p-xylylene) films for waveguide applications and OLED encapsulation," *Synthetic Metals*. 127 (2002) 189-193]. Choosing substrates with minimal absorption of near-infrared (NIR) laser radiation allows for "back-side" processing of the target by transmission of the laser through the substrate (FIG. 11B). Minimal differences appear in the exposed areas of substrate created by front-side dewetting when compared to back-side dewetted samples. By directing the beam 90 through the low-absorption substrate 84, 86, dewetting can be initiated through underside exposure (i.e., back-side exposure). By this technique, more variation in target fixturing can be realized.

Exposure of bismuth samples 82 proceeded in a "back-side" configuration where laser light 90 was directed through the substrate 84, 86 before interacting with the metallic layer 82 (FIG. 11B). Under this configuration, a simple line-array with line spacing of 200 μm was dewetted from the 1.6 μm-thick metallic layer 82. The target stage was adjusted accordingly to ensure that the bismuth layer was within the focal plane of the lens (not shown). Laser settings were set to match the general laser parameters for bismuth samples as described in Examples 5 and 6. A shallow relief 92 milled into the welding stage 94 prevented transfer of the dewetted material onto the underlying support as diagramed in FIG. 11B. The relief also ensured that the dewetted bismuth had sufficient room to dewet and accumulate on the par-C/bismuth interface in an unhindered manner.

Profilometry analysis revealed no significant difference in resulting cross-sectional thickness of the dewetted materials. Measurements made under optical microscopy revealed a consistent width of 30 μm for the dewetted areas regardless of exposure side. This is consistent with literature evidence of low absorption of NIR light for both par-C and borosilicate glass substrates. Significant amounts of beam attenuation through the substrate or reflection by material interfaces would have resulted in decreased trench width as beam diameter is partly a function of intensity while in the focal plane. Additionally, there was no considerable difference between the samples with respect to beam damage of the substrates, nor was there any need to adjust laser exposure settings. The role of gravity in bismuth dewetting appeared negligible at these length scales, as there was no significant increase to the average height under back-side dewetting.

Figure 8A:
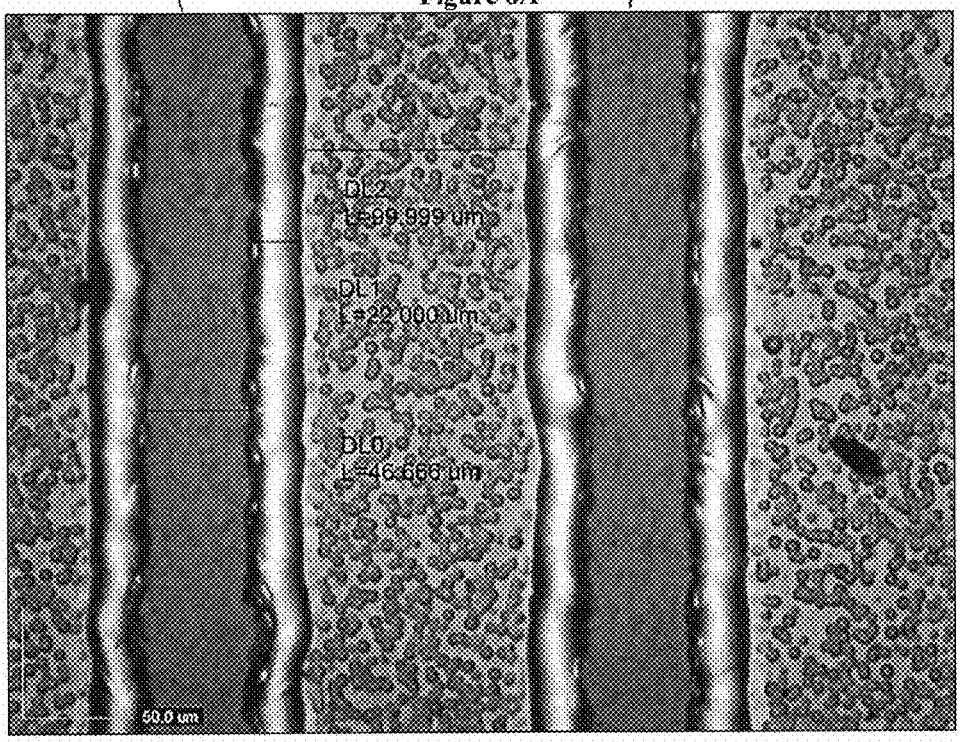
FIGS. 8A and 8B illustrate line structures formed from thin films by front-side directed dewetting (FIG. 8A) and back-side directed dewetting (FIG. 8B), according to embodiments of the present invention.
Figure 8B:
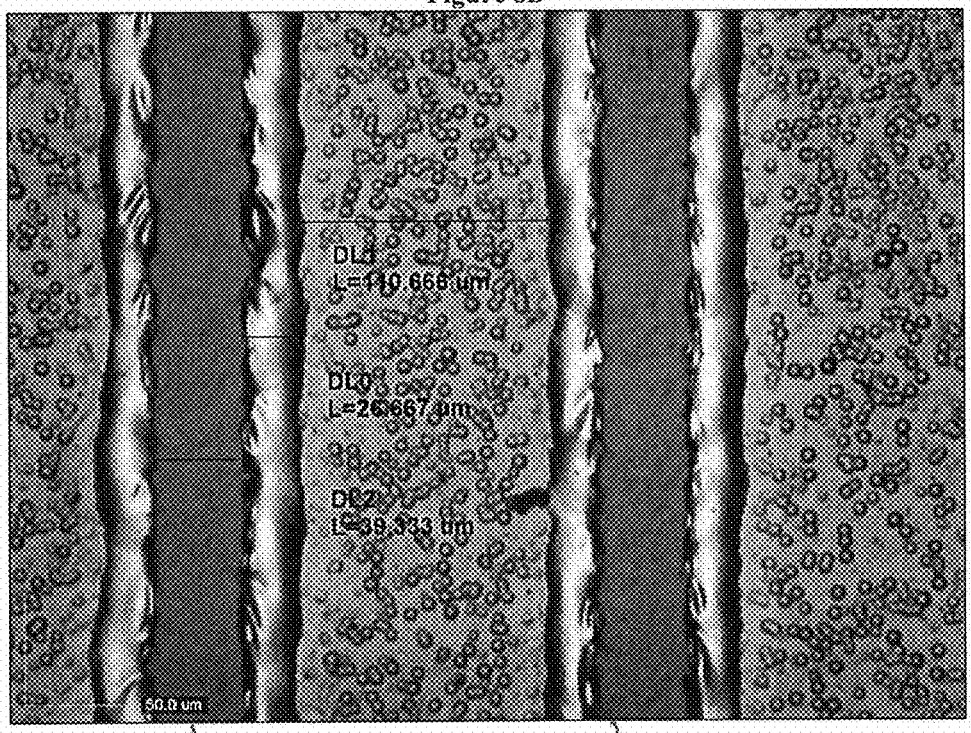

FIGS. 8A and 8B show a comparison between "front-side exposure" (FIG. 8A) and "back-side exposure-" (FIG. 8B). FIG. 8A and FIG. 8B each show two dewetted lines 46, 48, 50, 52 that are centered 200 μm apart. Laser settings for both samples were as follows: 50 kHz, 5 μs, 10 W, 350 mm/s, cover gas at 80 SCFH. Both trials were performed on the same slide, which consisted of 1.5 μm of bismuth. The low-absorption substrate consisted of 16 um of parylene-C polymer on top of 1 mm of borosilicate glass. FIG. 8A was constructed using exposure of the top surface or "front-side patterning" and FIG. 8B was constructed using exposure of the underside through the low-absorption substrate or "back-side patterning." Both approaches were successful and exemplified the ability to form structures through a material. Without being bound by theory, as no material was ablated forming a vapor, one can apply this writable technology to enclosed structures as long as the outside media is mostly transparent to the wavelength of the laser beam.

Accumulated Structures

When a target material (e.g., bismuth) melts and dewets from a substrate, rather than ablating away, the target material can be directed and "pushed" into larger and larger aggregate structures. To explore the accumulation behavior of dewetted metal deposited on par-C, multiple, closely-spaced scanner passes were used to successively melt an ever growing amount of material. The overall shape of the accumulated structure was designed as a single, linear, thick bead of dewetted bismuth. The initial film used was a 1.6 μm thick film of Bi deposited upon a 22 μm par-C/1 mm borosilicate glass substrate. Scanning line pitch for the accumulated structure was set at 20 μm and caused the dewetting metal to dewet in the direction of the advancing line front. In total, the accumulated line consisted of 36 scanner passes—18 passes on each side of the line, which "pushed" material towards the middle and combined to create one structure. General laser parameters for bismuth samples as described in Examples 5 and 6 were used for each scanner pass.

Figure 6A:
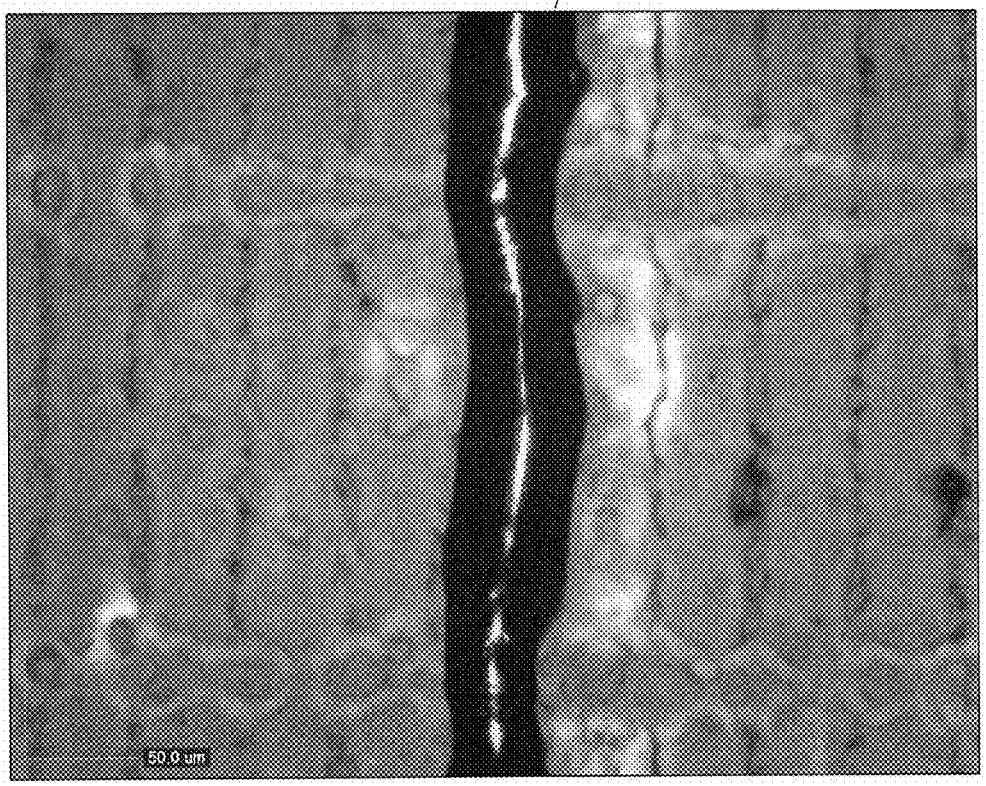
FIGS. 6A and 6B show a built up ridge of dewetted material according to an embodiment of the present invention (FIG. 6A) with corresponding profilometer data (FIG. 6B)
Figure 6B:
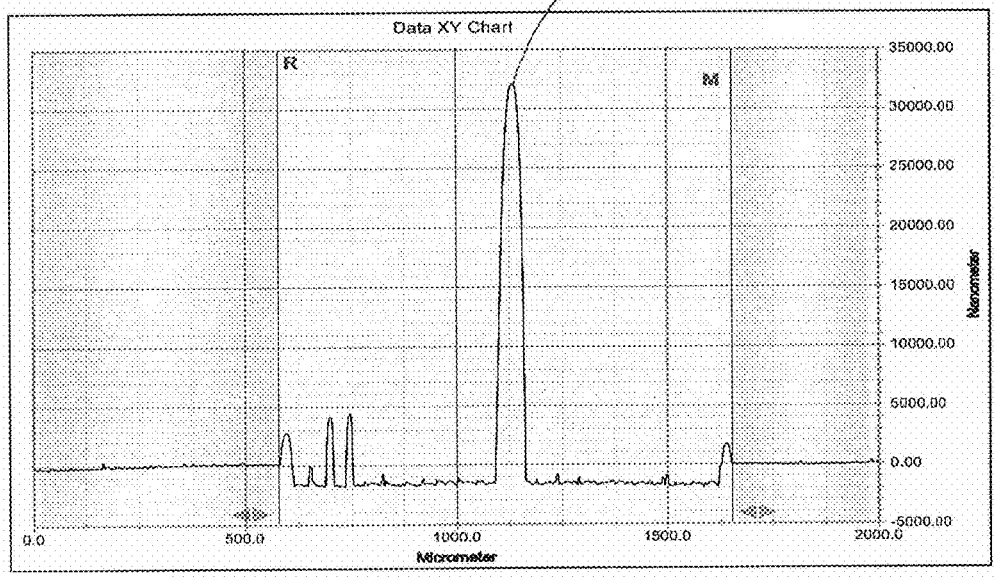
Figure 7:
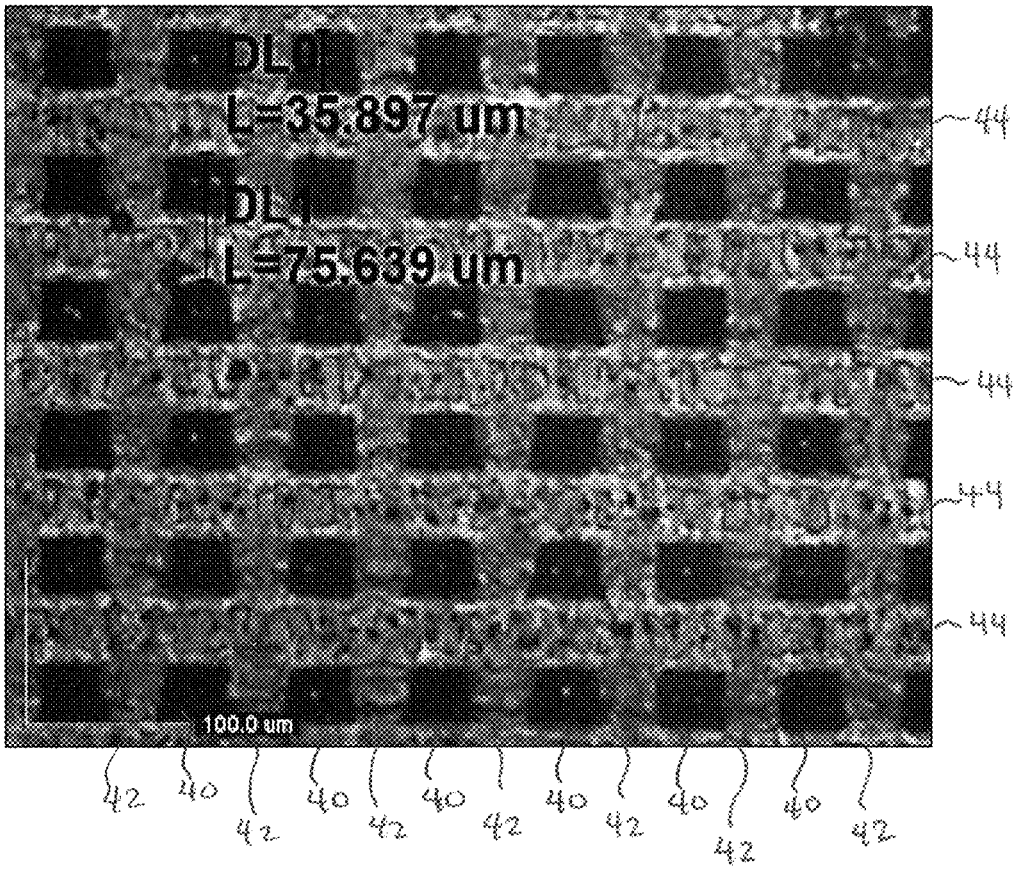
FIG. 7 shows a cross-hatch pattern of dewetting lines created by scanning a 2.5 μm thick base material according to a method of the present invention.

FIGS. 6A and 6B provide an example of such a built up structure 38 along with profilometer data for height measurement (FIG. 6B). The laser settings used were as follows: 50 kHz, 5 μs, 10 W, 350 mm/s, cover gas at 80 SCFH. The "push" lines were centered 45 μm apart to leave a line 38 measuring 40-50 μm wide and 31.6 um high. This structure was created from a 2.0 μm thick layer of bismuth metal on top of 16 μm of parylene-C polymer and 1 mm of borosilicate glass.

Figure 20:
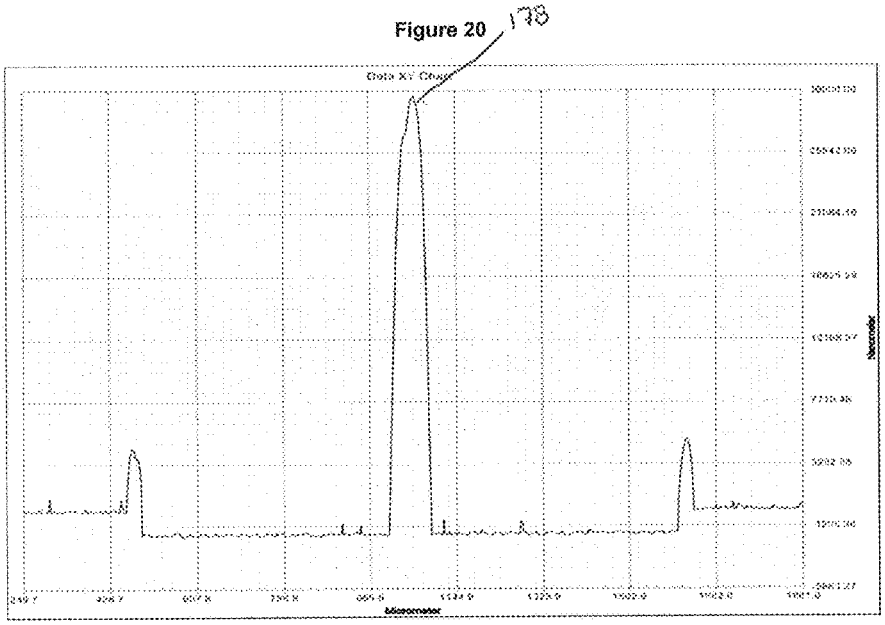
FIG. 20 shows a profile of a structure built using successive laser passes according to an embodiment of the present invention.

FIG. 20 presents a single-line profile that was formed by scanning the laser across the surface of a Bi film deposited upon a parylene-C covered surface. Pitch was set at 20 μm. At such a small pitch, the dewetting metal preferentially accumulated on the same side as the direction of advancing laser passes. For this example, an initial set of 18 lines were dewetted, with the lines advancing left to right. A second set of 18 lines were dewetted, with the lines advancing from right to left. The second set of lines was placed in such a position so that the end of the final line would be positioned parallel to the end of the first set of lines. This caused the accumulated metal to combine and form one, very thick structure, represented by the profile peak 178. The formed structure was itself a linear feature and measured 29.9 μm high, nearly 1900% as thick as the original 1.6 μm thick Bi film. With a width measurement of 56 μm, the feature had an aspect ratio of 0.53:1.0.

Alternate geometries of dewetted Bi were realized in the form of spirals. A spiral with a 2 mm outer diameter, a 200 μm inner diameter, and a spiral branch distance of 20 μm was dewetted from the metallic layer. Profilometry was used for volumetric analysis of the accumulated material at the center of the spiral. An identical accumulated structure was created from a 1.6 μm tin film using the general laser parameters for tin films as described in Example 5.

Figure 21:
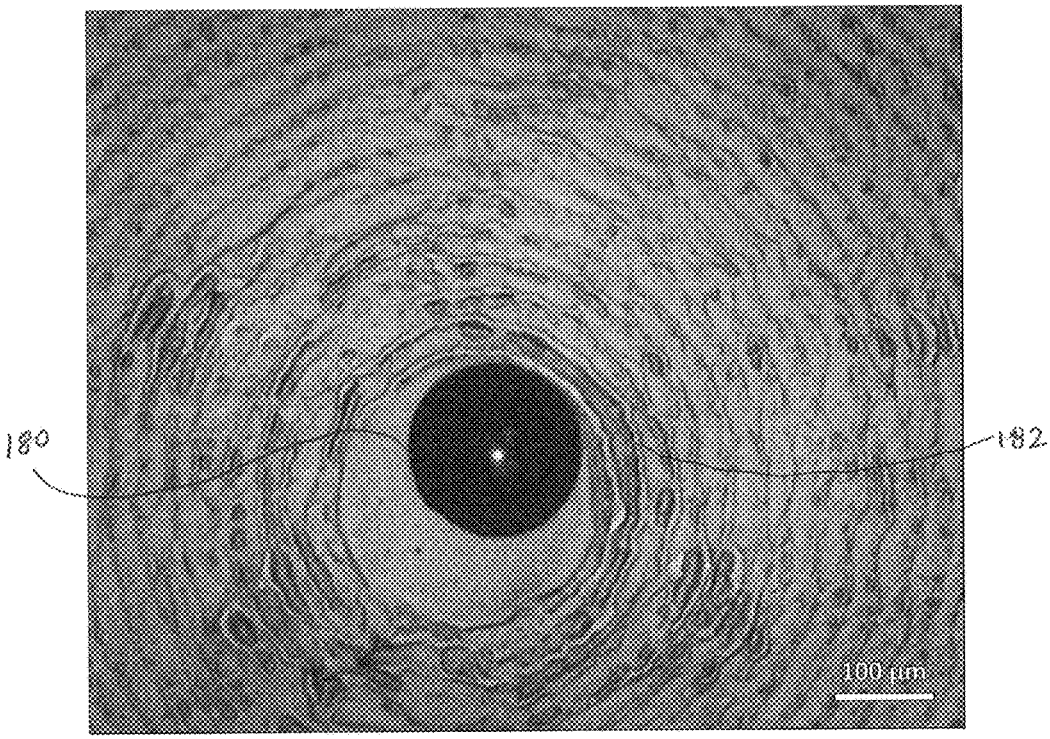
FIG. 21 shows a spiral dewetting pattern of a tin thin film according to an embodiment of the present invention.
Figure 22A:
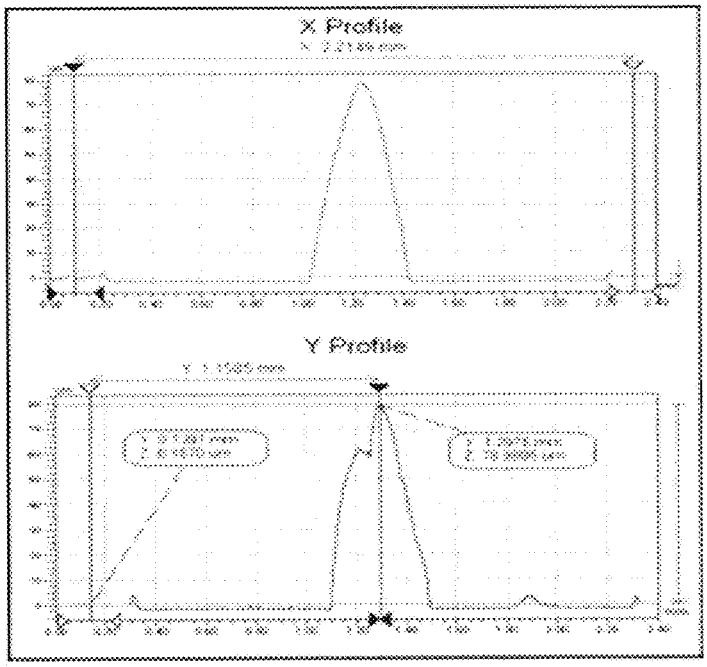
FIGS. 22A, 22B, 22C, and 22D show profilometry data on a built mound of dewetted material dewetted by successive passes along a spiral path according to an embodiment of the present invention, wherein the scan data provides two-dimensional height measurement (FIG. 22A) and three-dimensional height measurement (FIGS. 22B and 22D), wherein volumetric analysis (FIG. 22C) reveals a 2.8% discrepancy between positive and negative displaced material.
Figure 22B:
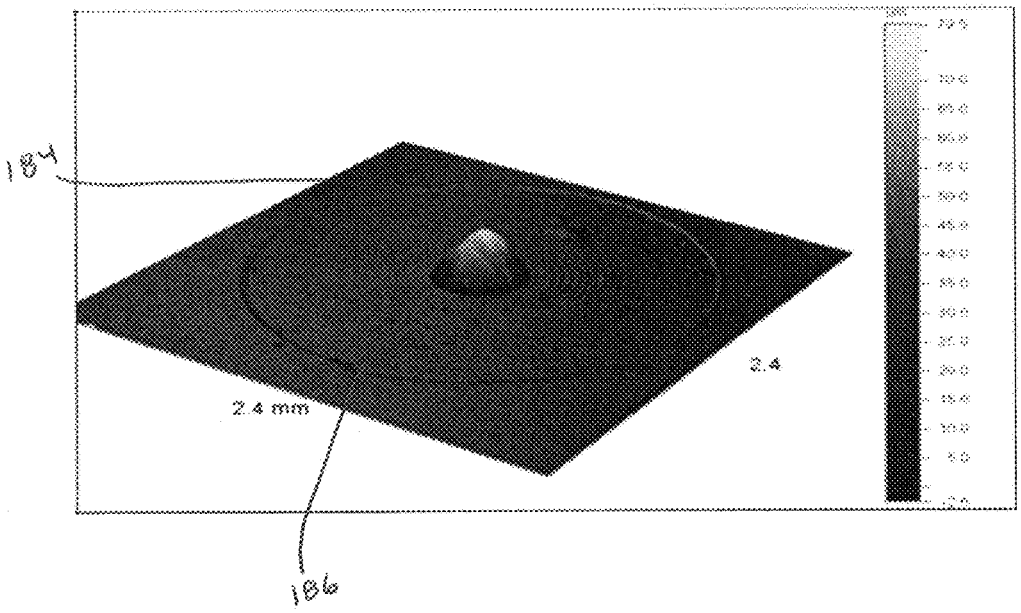
Figure 22C:
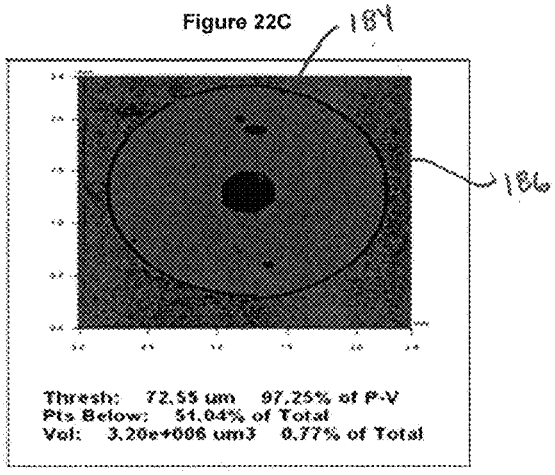
Figure 22D:
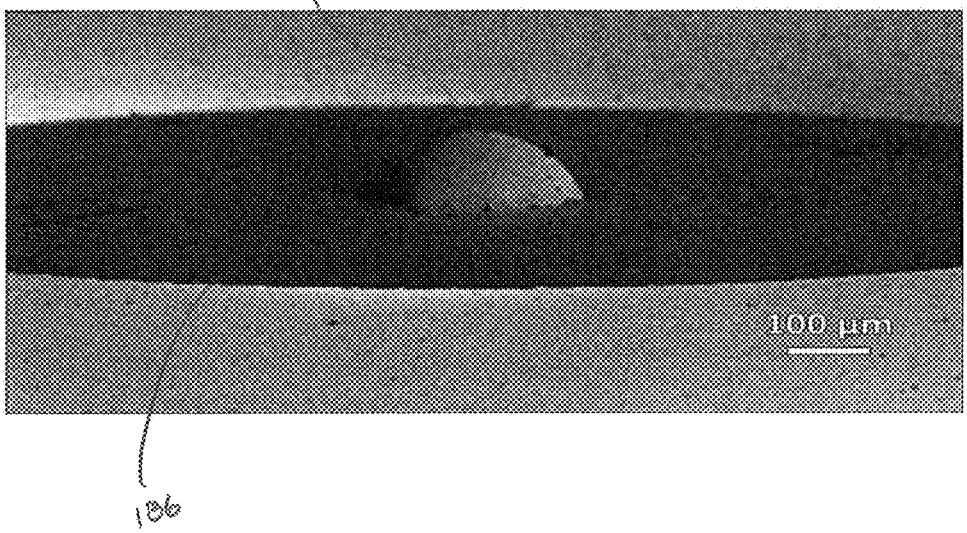

Spiral dewetting of a 1.6 μm thick Bi film produced a single, large, hemispherical accumulation 184 in the center of the spiral 186 (FIGS. 22B and 22D). The spiral pattern began at a radius of 1 mm, where every 360 degrees along the spiral path brought the laser spot 20 μm closer to the center. Marking along the spiral path stopped once the laser reached a radius of 150 μm. The resulting feature 184 measured 79 μm tall, a total 4900% thicker than the original 1.6 μm thick film. The diameter of the accumulation 184 was measured at 160 μm, which gave an aspect ratio of 0.49:1.0. Total time for formation was 0.669 seconds. In total, the spiral 186 had 42.5 layers of dewetting passes combined into one large accumulation 184. Volumetric analysis was performed on this spiral dewet pattern (FIG. 22B). FIG. 22B shows the computed displaced volume as $9.6\times10^6$ $\mu m^3$ with a total of $2.6\times10^5$ $\mu m^3$ of unaccounted negative volume. This 2.8% discrepancy indicates that multiple laser exposure passes during the material "push" did not introduce significant amounts of ablation. Tin also dewet easily under a spiral exposure (FIG. 21). After laser exposure, the agglomerate 180 at the center of the spiral 182 measured 131 μm thick with a diameter of 200 μm, which translated to an aspect ratio of 0.66:1.0; the highest aspect ratio achieved (FIG. 21).

Example 7: Complex Dewetting Geometry

Periodic Shapes

The laser system of the described invention allows for detailed and complex patterning of film. In this study, the laser system's galvanometer scanner system was used to create periodic shapes on film targets.

Figure 23:
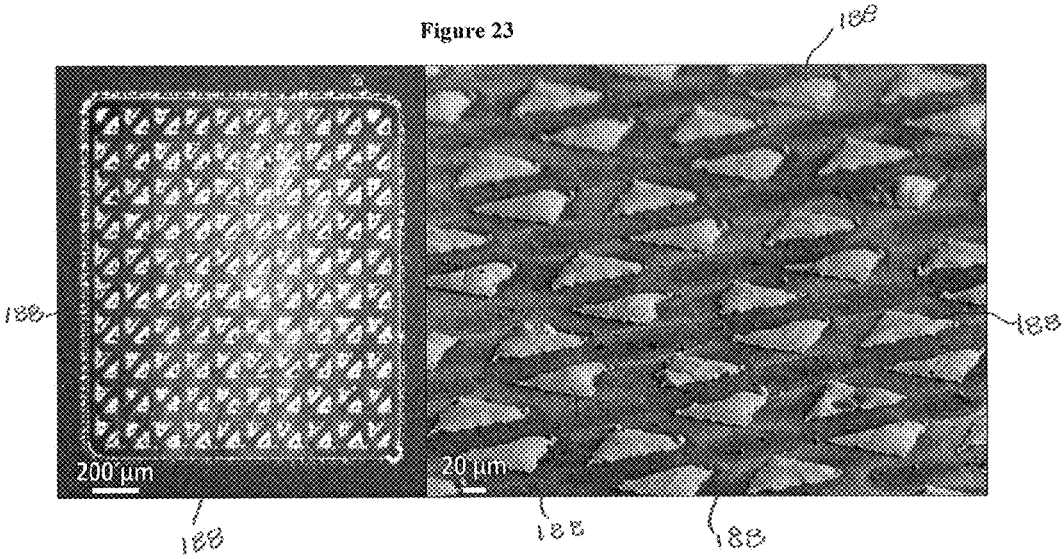
FIG. 23 shows two views of periodic triangular structures dewetted from bismuth deposited onto a parylene-C covered glass slide according to an embodiment of the present invention, wherein the triangular structures measured 70

Referring to FIG. 23, periodic shapes 188 were realized on 1.6 μm thick bismuth targets deposited upon 22 μm par-C/1 mm borosilicate substrates. Laser settings matched the general laser parameters for bismuth films described in Examples 5 and 6. Within the confines of a 1 mm by 1 mm square, dewetting scanner passes were conducted with a pitch of 100 μm in both the X- and Y-directions. The resulting square structures were then dewet along the diagonals to create triangular structures 188.

Measurements of the features 188 formed from a 1.6 μm thick Bi film revealed triangular dimensions of 70 μm×70 μm by 100 μm. At the designed dimensions, the features 188 agglomerated together to make a continuous structure without any residual as-deposited film visible (FIG. 23). The thickness of the features 188 was measured as 3.2 μm from a 1.6 μm film. Each feature remained disconnected from one another and exhibited little variation in dimensions.

Polygonal and Circular Accumulated Structures

Angles and corners present a particular challenge for dewetting, especially when building structures in height. In order to demonstrate the ability of the described laser scan system and dewetting technique to form angles and corners, non-functional polygonal and circular structures were created on a film target.

Accumulation processing techniques were used to create non-functional polygonal and circular structures (e.g., a triangle, a circle, a square and a cone).

Referring to FIGS. 24A and 24B, from a 1.6 μm bismuth film 208, triangle 190, circle 192 and square 194 shapes as high as 17 μm and as low as 10 μm were realized (FIG. 24A). Each side of each triangle 190, circle 192 and square 194 was constructed from the combined dewetted material 198, 202, 206 originating from 18 adjacent scanner passes (9 from each side) which were pushed together to form the intended geometry. Each pass was spaced at 20 μm. The shapes 190, 192, 194 were formed with clean lines and uniformity of width. An artifact from the geometry of the multiple passes caused a variation in the accumulated height along the length of the shapes parallel to the substrate. The highest areas of accumulation occurred near vertices, as the laser passes needed to create them converged to bring a greater amount of material towards the shape in that area than at the edges of the shape. In contrast, the circle remained consistent in height throughout the length.

Additionally, an application-oriented design was attempted. Referring to FIG. 25, inter-digit electrodes 208 (IDEs) were dewet from a 1.6 μm Bi film 210 using general laser parameters. Such IDEs can be constructed with variable spacing, variable electrode width, variable height, and lends itself well to defocused laser processing to normalize the height of the dewetted beads. In total, each electrode was designed with 45 inter-digits each. A large IDE array 208 with a set pitch of 110 μm was dewetted from a 1.6 μm Bi film on a par-C coated borosilicate slide (not shown). The attempted IDEs were designed with an electrode width of 80 μm with a spacing of 30 μm. Together, the IDE filled an area 14 mm by 10 mm. The IDE had two electrode pads, each with 45 inter-digits. These inter-digits measured 80 μm wide and had a space of 30 μm in between adjacent inter-digits and were used to explore the completeness of the dewetting process by electrical isolation tests. (FIG. 25). A two point resistance test between the two electrode pads produced resistance values exceeding the Gigaohm capacity of the ohmmeter. Additionally, each electrode pad exhibited electronic isolation from the surrounding as-deposited film. For this example, each inter-digit was constructed with only one pass of the beam, indicating that complete dewetting occurred under the described general laser parameters. Without being bound by theory, alternative design geometries may allow further increase of the spacing in between each inter-digit by introducing additional laser passes between digits, which may also have the effect of increasing the cross-sectional height of the inter-digits via a preferential accumulation "push" mechanism, while defocused exposure of the IDE may create uniformly thick digits that still measure thicker than the original film.

Figure 3A:
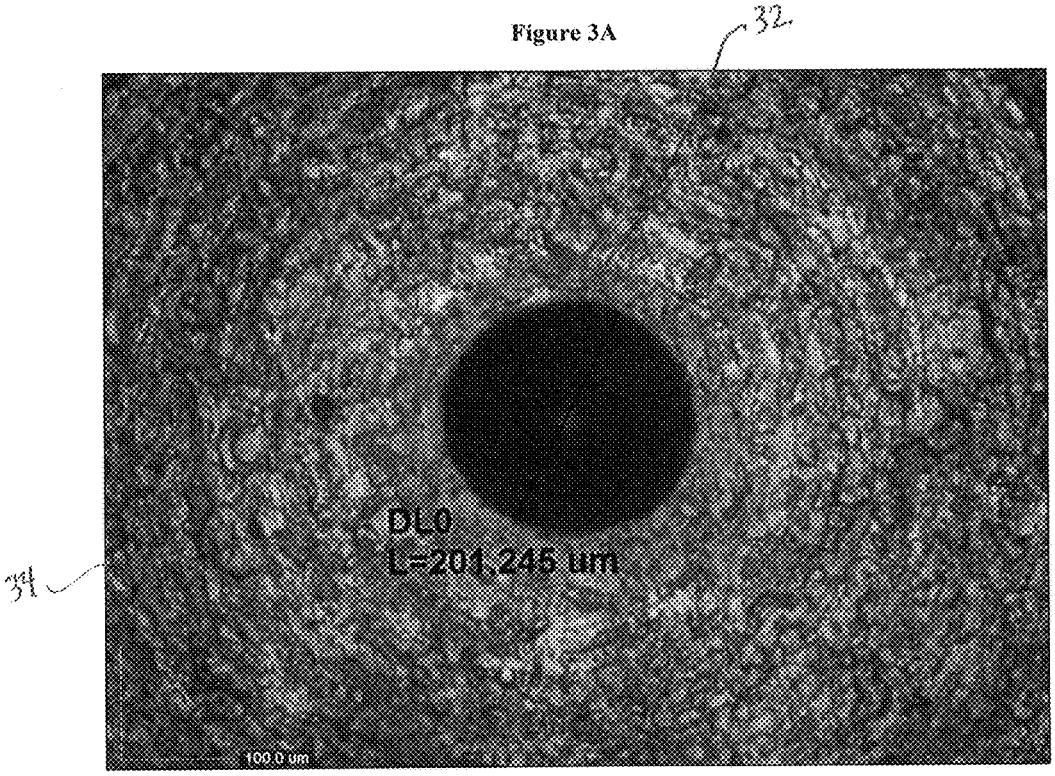
FIGS. 3A and 3B show a "cone" structure created by a spiral scan according to an embodiment of the present invention (FIG. 3A), and a profile of the cone structure of FIG. 3A.
Figure 3B:
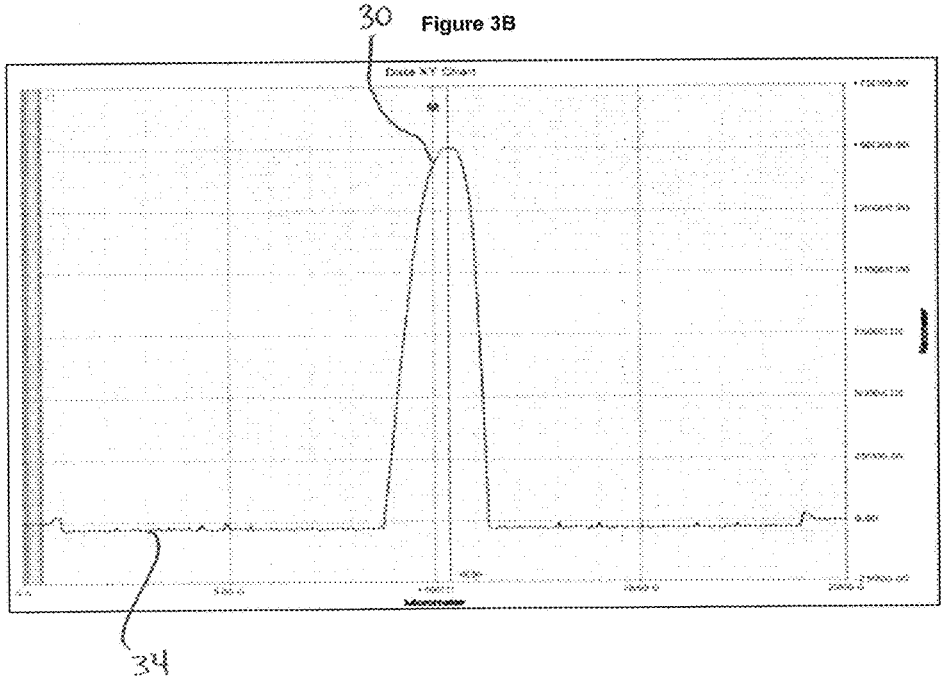

By scanning in a spiral pattern, a cone structure created from dewetted material was realized. Height and width dimensions of this cone/bump structure were determined by the number of layers in the spiral pattern as well as the surface energies of the particular material. FIG. 3A shows a top down view of such a cone/bump structure 32 with a 100 μm maximum inner radius. Profilometer measurements (FIG. 3B) indicated a maximum height of 150 μm, which is 75 times thicker than the base material (2.0 μm) (not shown). The laser parameters for this trial were as follows: 50 kHz, 5 μs, 10 W, 350 mm/s, with a cover gas flow of 80 SCFH. The sample consisted of 2.0 μm of Bismuth (not shown). The substrate 34 consisted of 16 μm of parylene-C polymer on top of a 1 mm borosilicate glass slide.

Figure 4A:
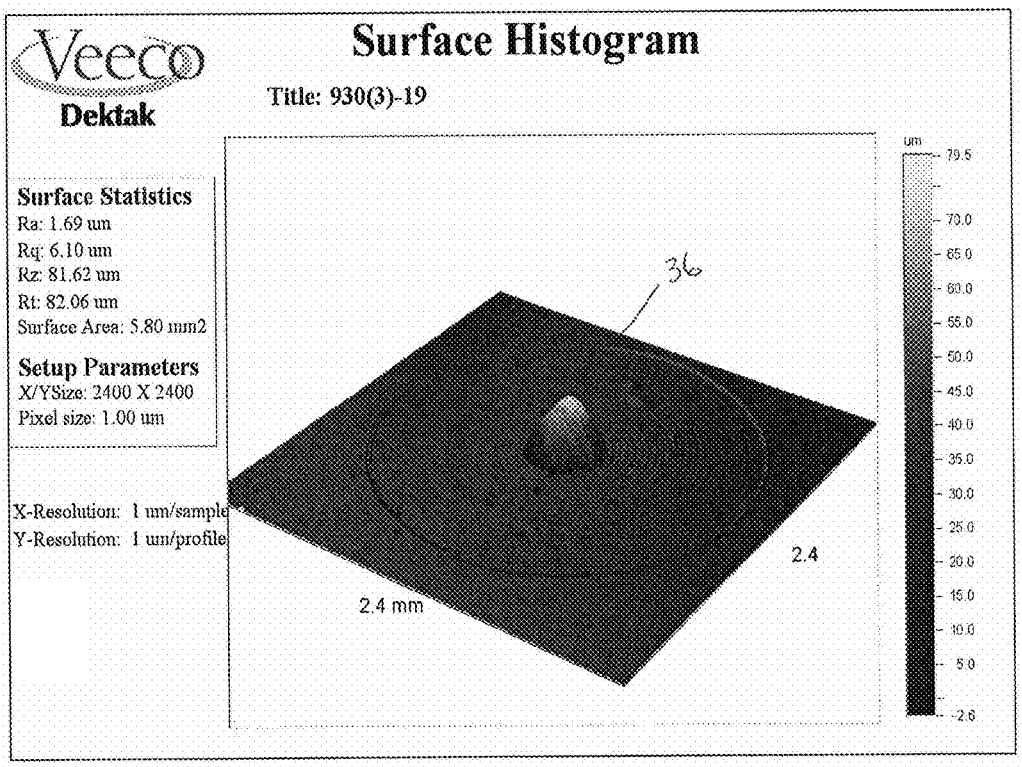
Figure 4B:
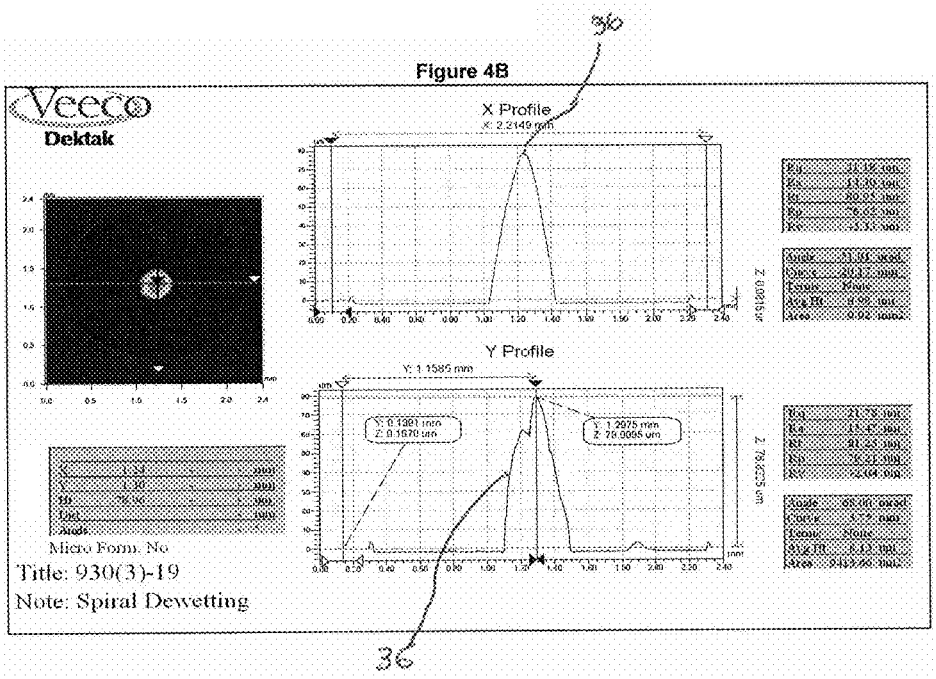
Figure 4C:
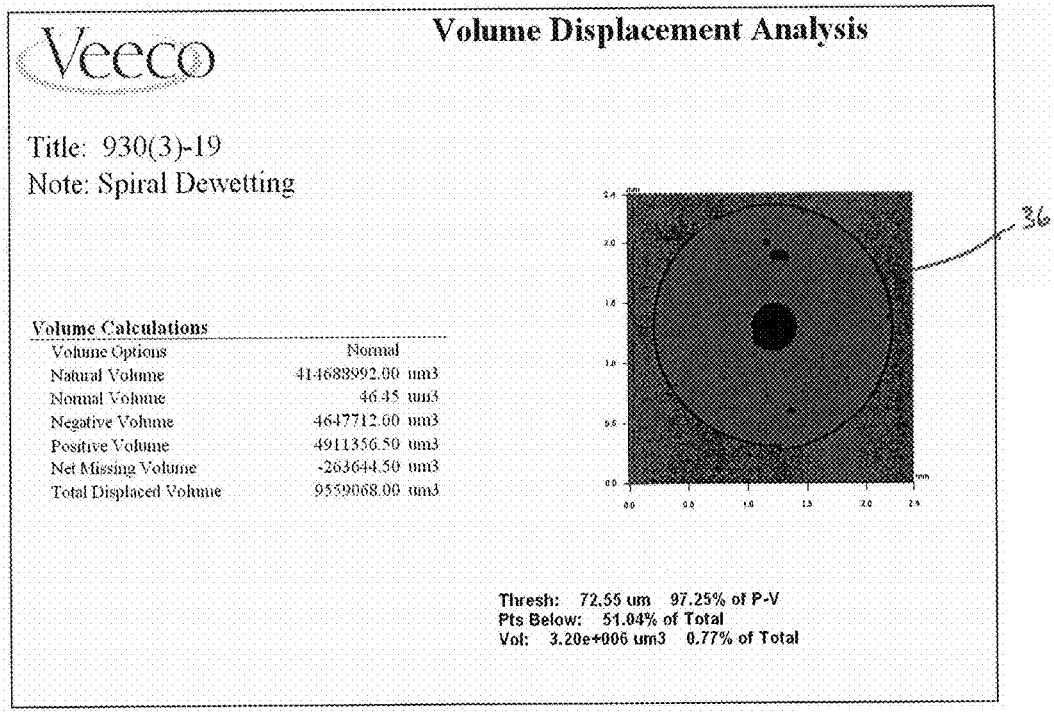
Figure 5A:
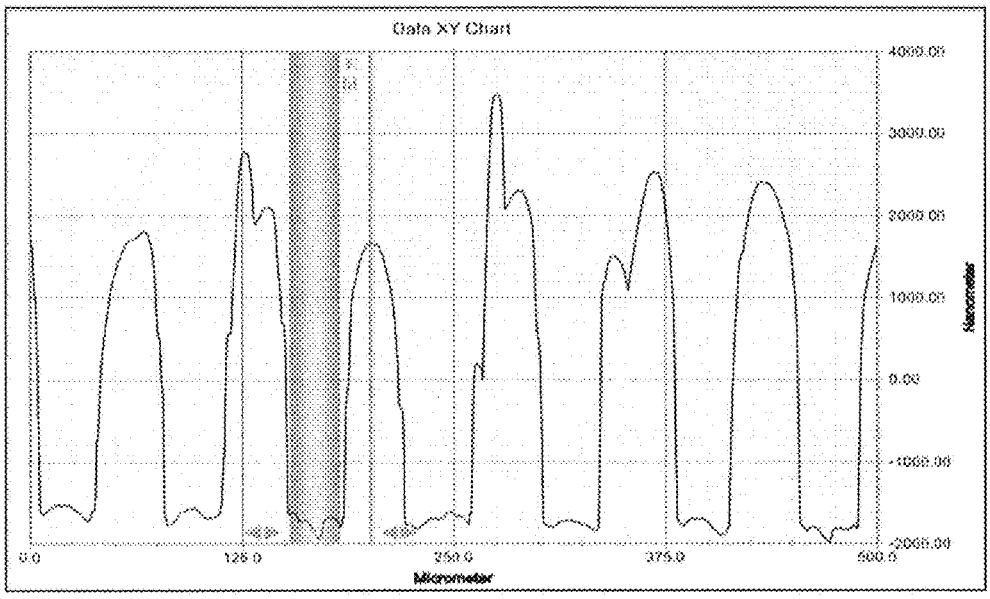
Figure 5B:
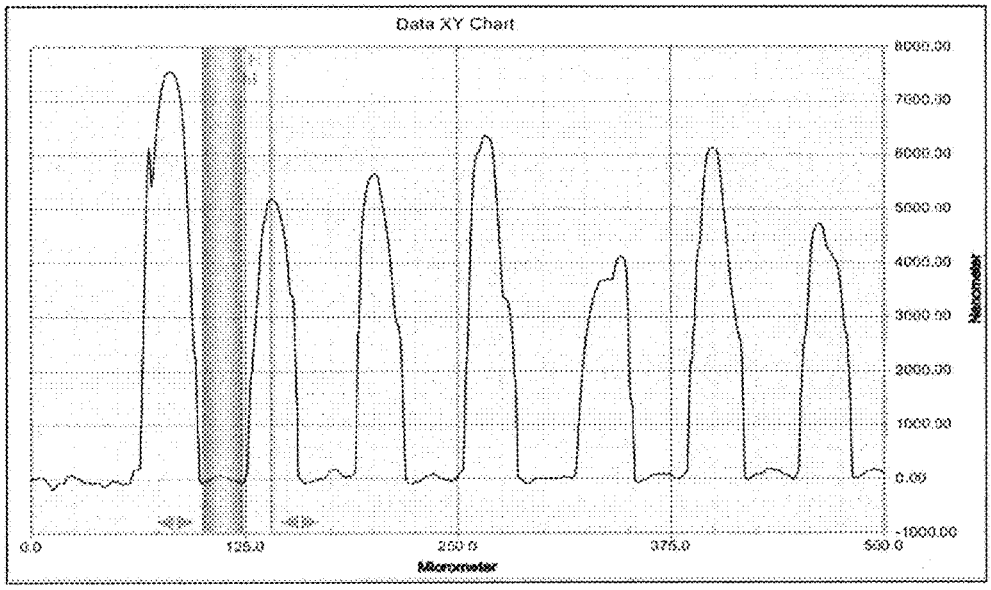
Figure 5C:
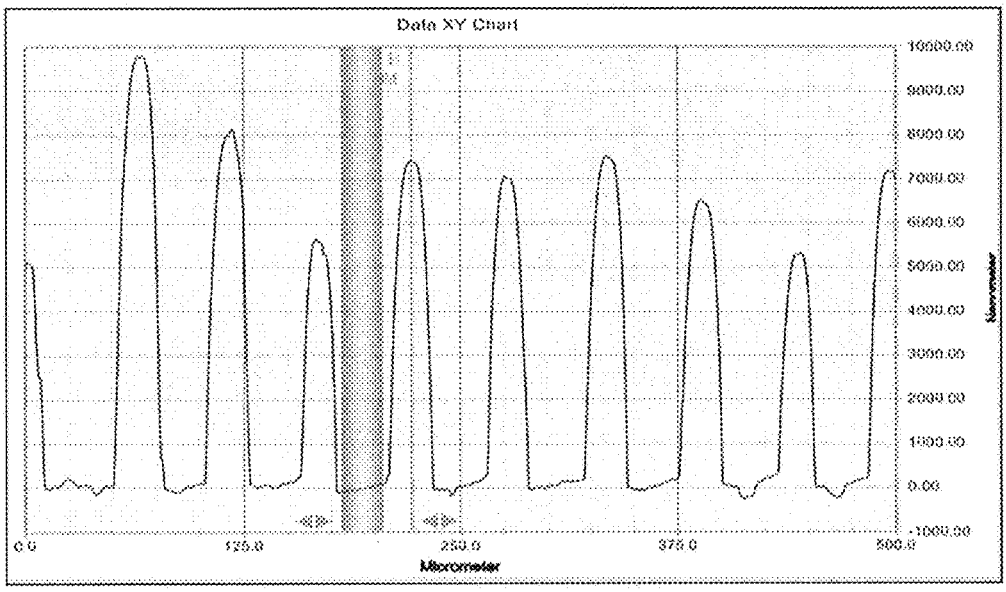
Figure 5D:
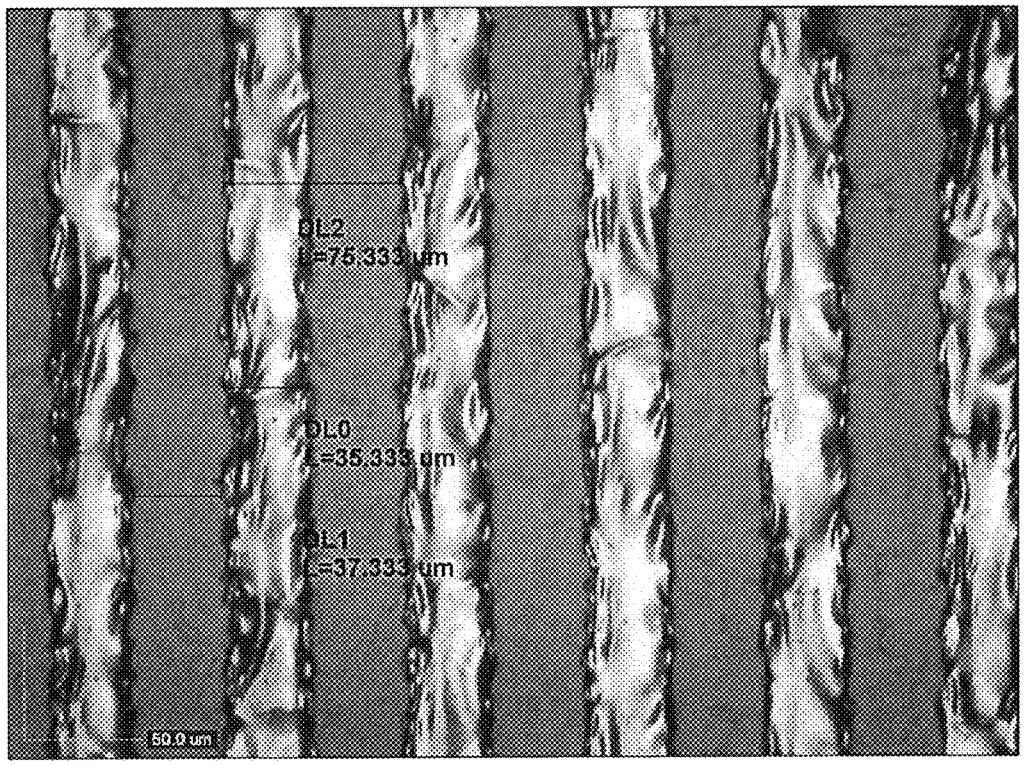
Figure 5E:
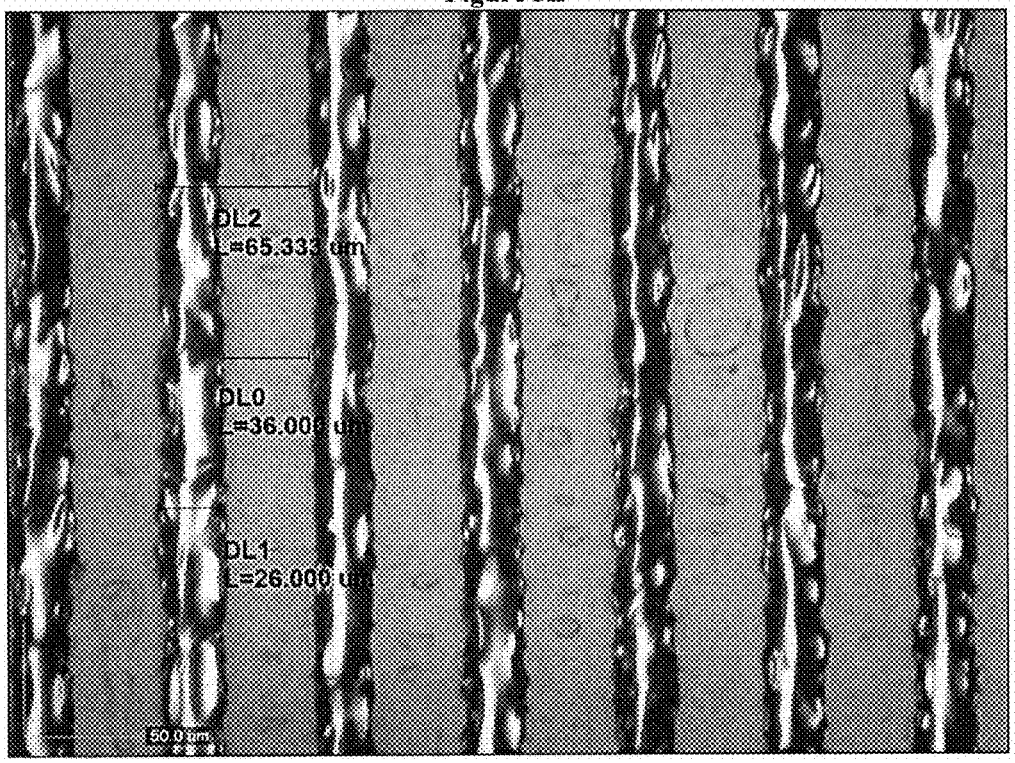
Figure 5F:
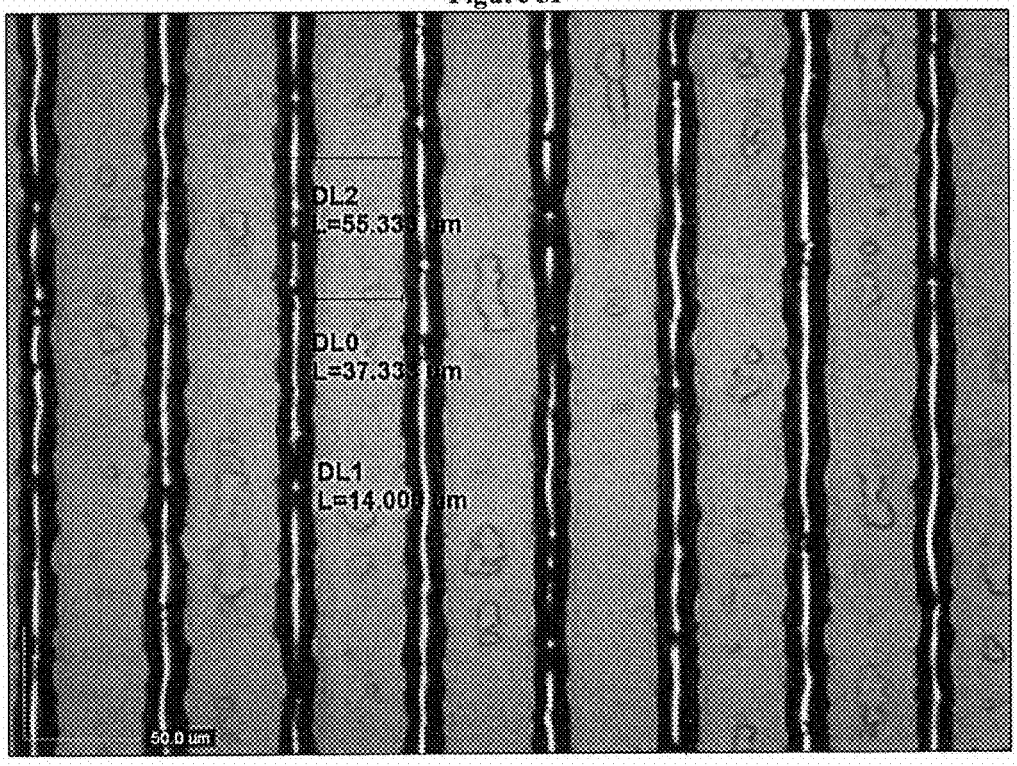

A 3D scan of a second spiral trial (FIG. 4A) allowed for volumetric analysis of the cone/bump structure 36, the result of which indicated that less than 3% of the displaced volume was unaccounted (FIG. 4C). This is within the margin of error for the measurement, and suggests that there was negligible material ablation. The laser settings were as follows: 50 kHz, 50 μs, 10 W, 350 mm/s, cover gas at 80 SCFH. Each beam pass was centered 50 μm apart from the center of the previous pass. A final maximum inner radius of 150 μm was realized. This sample consisted of 1.5 μm of bismuth on top of 16 μm of parylene-C polymer and a 1 mm thick borosilicate glass slide.

Complex Structures

Referring to FIG. 26, as an example of the level of complexity possible with the scan system and dewetting technique beyond simple polygonal or circular shapes, the letters "R" and "U" were designed using the described techniques. Both letters were constructed using general laser settings as described in Examples 5 and 6. The attempted "R" was pushed together from 18 beam passes (9 passes on each side) with a 20 μm spacing. The attempted "U" was designed as an IDE with two inter-digits per electrode pad. Each digit is 70 μm wide and spaced 30 μm apart from each other. Each letter created was designed to fit within a 2.3 mm×2.3 mm square.

For the first letter (capital "R") a "push" approach was attempted. To this end, nine successive passes of the laser with a pitch of 20 μm were used to push material from the outside of the "R" to create the general shape of the letter. Nine passes from within the closed section of the "R" pushed material outward to finish the shape of the letter. The second letter chosen was a "U" and was designed as a small IDE. Each electrode pad boasted only two inter-digits, each curved to make the body of the letter. Cross-sectional views of the constructed features were created using conductive epoxy and ion cross-polishing, which highlighted the magnitude of the features in light of the deposited film. Despite the complex shape, electronic isolation was maintained. The resistance values measured across the electrodes exceeded the capacity of the Gigaohm range of the ohmmeter, which indicated that neither the shape of "pushed" structures nor the shape of IDEs had an effect on the completeness of dewetting. Height values for the accumulated "R" structure measured at 10 μm in most locations, but rose to 17 μm in certain areas of the letter, most notably in the serifs of the "R." The "U" IDE exhibited typical heights for beads created form a single laser pass and measured 3.2 μm from the par-C substrate.

Notably, after preparing the target and drawing the scanner program, dewetting the bismuth into the "R" feature took 0.66 seconds to complete and the "U" feature took 0.23 seconds to complete.

The lowered absorption of NIR light characteristic of the underlying substrates proves especially advantageous when building up dewetted structures, since this prevents serious substrate damage of the par-C or glass after successive, overlapping passes.

Example 8: Physical and Electronic Characterization

Samples were characterized using an optical microscope (Leitz) and a field-emission scanning electron microscope (FESEM) operating at 5 kV. Sample features were encased in a silver-containing, conductive epoxy to limit charging effects during characterization. A diamond band saw running at 250 rpm and an ion cross-polishing system (JEOL) running at 5.5 kV, were used to cut and polish cross-sectional samples of the constructed features. Singular profilometry scans were conducted with a Dektak 150 profilometer with a lateral resolution of 0.050 μm per sample. Three-dimensional models and volumetric data were processed with Veeco "Vision" software.

While the present invention has been described with reference to the specific embodiments thereof it should be understood by those skilled in the art that various changes may be made and equivalents may be substituted without departing from the true spirit and scope of the invention. In addition, many modifications may be made to adopt a particular situation, material, composition of matter, process, process step or steps, to the objective spirit and scope of the present invention. All such modifications are intended to be within the scope of the claims appended hereto.

What is claimed is:

1. A method of patterning a thin film deposited on a substrate, the thin film including a thin film material, the method comprising the steps of:

providing a substrate having the thin film deposited thereon, selecting a desired pattern of the thin film deposited on the substrate, scanning the thin film with a focused field of thermal energy provided by a laser, thereby dewetting the thin film material from the substrate, wherein the step of scanning the thin film with the focused field of thermal energy results in an ablation of the film material of less than 10%, displacing at least a portion of the dewetted thin film material from the substrate to form a continuous area of exposed substrate having the desired pattern, and forming the displaced thin film material into a continuous bead of displaced thin film material, wherein the continuous bead of displaced thin film material is adjacent to the continuous area of exposed substrate, wherein the scanning step is performed by moving the focused field of thermal energy in a continuous motion across the thin film with the focused field of thermal energy in contact with the thin film, wherein the thin film material is a metal or metal alloy, and wherein the substrate is a polymer.

2. The method according to claim 1, wherein the focused field of thermal energy includes at least a first wavelength, the thin film material is capable of absorbing energy having a second wavelength, and the first and second wavelengths are the same such that the thin film material absorbs at least a portion of the thermal energy.

3. The method according to claim 2, wherein the substrate does not absorb energy having the first wavelength of the focused field of thermal energy, such that scanning with the focused field of thermal energy does not change the substrate.

4. The method according to claim 1, wherein the metal or the metal alloy is comprised of bismuth.

5. The method according to claim 1, wherein the metal or the metal alloy is comprised of tin.

6. The method according to claim 1, wherein the polymer is parylene.

7. The method according to claim 6, wherein the parylene is parylene C.

8. The method according to claim 1, wherein the ablation of the thin film material is less than 5%.

9. The method according to claim 1, wherein the ablation of the thin film material is less than 3%.

10. The method according to claim 1, wherein the ablation of the thin film material is 2.8%.

11. The method according to claim 1, wherein the ablation of the thin film material is 0.5%.

12. The method according to claim 1, including the further step of scanning the thin film along a side of the continuous bead opposite the continuous area of the substrate with the focused field of thermal energy, thereby dewetting the thin film material along the side of the continuous bead and displacing the dewetted thin film material into contact with the continuous bead.

* * * * *